US007536120B2

(12) United States Patent
Ishida

(10) Patent No.: US 7,536,120 B2
(45) Date of Patent: May 19, 2009

(54) IMAGE FORMING APPARATUS WITH TONER CONTENT DETECTION AND IMAGE DENSITY DETECTION

(75) Inventor: Yusuke Ishida, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 195 days.

(21) Appl. No.: 11/508,157

(22) Filed: Aug. 23, 2006

(65) Prior Publication Data

US 2007/0047981 A1 Mar. 1, 2007

(30) Foreign Application Priority Data

Aug. 26, 2005 (JP) ..... 2005-246892

(51) Int. Cl.
*G03G 15/08* (2006.01)

(52) U.S. Cl. ..... 399/27

(58) Field of Classification Search ..... 399/27, 399/38

See application file for complete search history.

(56) References Cited

U.S. PATENT DOCUMENTS 6,879,788 B2 4/2005 Ito et al. ..... 399/49
7,010,237 B2 3/2006 Suzuki et al. ..... 399/27
7,013,095 B2 3/2006 Ishida ..... 399/55
7,027,746 B2 4/2006 Suzuki et al. ..... 399/27
7,164,868 B2 1/2007 Ishida ..... 399/49
2005/0100355 A1* 5/2005 Suzuki et al. ..... 399/27
2005/0191068 A1* 9/2005 Sato ..... 399/38
2006/0159474 A1 7/2006 Suzuki et al. ..... 399/27

FOREIGN PATENT DOCUMENTS

JP 2001-34018 2/2001
JP 2001-34019 2/2001

* cited by examiner

*Primary Examiner*—Quana M Grainger
(74) *Attorney, Agent, or Firm*—Fitzpatrick, Cella, Harper & Scinto

(57) ABSTRACT

An image forming apparatus includes a first and second developing devices for developing an electrostatic images with different developers a toner content detecting device for detecting a toner content in the developer in the first developing device, an image density detecting device for detecting an image density of a reference toner image formed using the first and second developing devices, and a controller for operating the apparatus selectively in a first and second modes. An image forming operation is carried out using only the first developing device in the first mode. An image forming operation is carried out using the first and second developing devices and the in the second mode.

8 Claims, 13 Drawing Sheets

(a) NORMAL IMAGE (b) PATCH IMAGE

IMAGE FORMING APPARATUS WITH TONER CONTENT DETECTION AND IMAGE DENSITY DETECTION

FIELD OF THE INVENTION AND RELATED ART

The present invention relates to an image forming apparatus, such as a copying machine and a laser beam printer, which employs an electrostatic recording method or an electrophotographic image forming method which develops an electrostatic image formed on an image bearing member, using developer made up of toner and carrier.

For example, an electrophotographic image forming apparatus generally forms images by carrying out each of the charging, exposing, developing, transferring, fixing, and cleaning processes. More specifically, after the surface of an electrophotographic photosensitive member (which hereinafter will be referred to as "photosensitive member") is uniformly charged, an electrostatic latent image (latent image) is formed by exposing the uniformly charged surface of the photosensitive member according to image formation information. This electrostatic latent image is developed into a toner image with the use of toner. Then, this toner image is transferred from the photosensitive member onto a sheet of recording medium such as paper. After the transfer of the toner image, the photosensitive member is cleaned; the transfer residual toner, that is, the toner remaining on the surface of the photosensitive member is removed. As for the recording medium onto which the toner image has just been transferred, it is subjected to heat and pressure. As a result, the toner image becomes fixed. This concludes the image forming sequence.

As the developer used for an image forming apparatus such as the one described above, a two-component developer, which is made up of essentially nonmagnetic toner (toner) and magnetic carrier (carrier), has come to be widely used, because of the recent improvements of a full-color image forming apparatus in terms of image quality and image formation speed.

In a developing device which uses a two-component developer, the mixing ratio between toner and carrier (ratio of weight of toner in developing device to that of developer in developing device, which hereinafter will be referred to simply as "toner density") changes. Therefore, it is necessary to supply, as necessary, a developing device with toner to keep the toner density of the developer in the developing device at a proper level. If the toner density is improper, formation of defective images, for example, images suffering from density deviation, images appearing rough, images suffering from fog, images suffering carrier adhesion, etc., sometimes occur, along with the scattering of toner. From the standpoint of reliably forming high quality images, therefore, it is very important to accurately detect the toner density, and execute control, based on the detected toner density, so that a developing device is supplied with a proper amount of toner.

Thus, various methods for detecting the toner density (toner density detecting method), for example, a method which uses an optical toner density detecting means and a method which uses an inductance-based density detecting means, have been proposed as the methods for controlling the amount by which toner is supplied. Some of them have been put to practical use. An optical toner density detecting method detects the changes in the reflection density of developer, whereas the inductance-based density detecting method directly detects the changes in the physical properties of a two-component developer itself, by detecting the changes in the magnetic permeability of the developer with the use of a sensor (toner density detecting means). The amount by which toner is supplied from a toner supplying means to a developing device is controlled based on the results of the detection.

There is also a toner replenishment controlling method based on the so-called patch-based density detecting method (image density detecting method). According to this method, a standard toner image (referential toner image; referential patch) is formed by developing a standard latent image (latent image for referential patch) formed on a photosensitive member. Then, the reflection density of the referential patch (standard toner image) is detected by an image density detecting means, while the patch is on the photosensitive member, or after the transfer of the patch onto a recording medium bearing member or an intermediary transfer member. Then, the amount by which toner is to be supplied from a toner supplying means to a developing device is controlled based on the results of this detection.

A toner density detecting method such as the above-mentioned optical density detecting method and inductance-based density detecting method is capable of directly detecting the toner density of the developer in a developing device, making it relatively easy to keep constant the toner density of the developer in a developing device. Further, it is advantageous in that even when toner density is very frequently detected, the so-called downtime, that is, the period in which an operation for actually outputting an image cannot be carried out, does not occur. On the other hand, it suffers from the problem that if the amount of toner charge (triboelectic charge of toner) changes due to the changes in ambient factors, for example, changes in temperature and/or humidity, or due to the toner deterioration attributable to elapse of time, toner density cannot sometimes be accurately controlled. More specifically, if a body of developer is kept in use for an extended length of time or continuously used, and/or if the ambient factors in which toner is used changes, the amount of toner charge drastically changes sometimes. Further, the amount of toner charge sometimes changes due to carrier deterioration. If the changes in the amount of toner charge, such as those described above, occur, even when toner density is kept at a proper level, the amount of force by which toner and carrier are attracted to each other changes. As a result, the amount by which toner transfers onto a photosensitive drum changes, affecting thereby an image forming apparatus in terms of the image density and color tone. In other words, a toner density detecting method such as the above-mentioned ones makes it difficult to keep an image forming apparatus stable in terms of the image density and color tone.

As for the patch-based density detecting method, what is detected by this density detecting method is nothing but the amount by which toner adheres to a photosensitive drum (recording medium bearing member or intermediary transfer member) to form a standard patch (reference patch). Therefore, the patch-based density detecting method is advantageous in that even if the amount of toner charge changes due to the changes in ambient factors such as temperature and humidity, and/or toner deterioration attributable to elapsed time, it can keep an image forming apparatus always proper in terms of the image density with which the image forming apparatus forms images; it can prevent an image forming apparatus from changing in the color tone in which the image forming apparatus forms images. Further, the patch-based density detecting method makes unnecessary the toner density detecting means which is to be disposed in a developing device, being therefore advantageous in terms of cost. However, it requires time for forming reference patches; in other words, it suffers from the downtime. This downtime is problematic from the standpoint of improving an image forming apparatus in image formation speed (productivity), that is, the number of image output per unit length of time.

The inventors of the present invention exhaustively examined the problems described above, discovering that for the purpose of solving the problems, it is effective to enable a user to choose between productivity or image quality based on the primary concern of the user, by providing an image forming apparatus with multiple image formation modes, which are different in the method used to detect the toner density or image density, based on the amount by which toner is supplied is controlled, so that the toner density detecting means or image density detecting means can be selectively used. The present invention was made based on the above-mentioned newly acquired innovative knowledge.

Japanese Laid-open Patent Application 2001-34018 discloses an image forming apparatus provided with a multicolor image formation mode for forming multicolor images with the use of multiple developing devices, and a monochromatic image formation mode for forming monochromatic images with the use of one of the multiple developing devices. Further, Japanese Laid-open Patent Application 2001-34018 discloses a toner density controlling method in which the amount (per toner replenishment operation) by which the black developing device, that is, the developing device which is used in both of the above-mentioned image formation modes, is supplied with toner to control the device in toner density in the black monochromatic image formation mode is rendered smaller than that in the full-color image formation mode. Further, Japanese Laid-open Patent Application 2001-34018 discloses that the frequency with which the black color developing device is controlled in toner density when the image forming apparatus is in the full-color mode is rendered higher than that when the image forming apparatus is in the black monochromatic image formation mode. However, the image forming apparatus disclosed in Japanese Laid-open Patent Application 2001-34018 is provided with only an optical sensor for detecting the amount of the toner (that is, image density) having adhered to the latent patch image, or a toner density measurement sensor for measuring the toner density of the developer in a developing device. In other words, the image forming apparatus in accordance with the invention disclosed in Japanese Laid-open Patent Application 2001-34018 is not an image forming apparatus that has multiple image formation modes for controlling the amount by which toner is supplied to a developing device, by selectively using the toner density detecting means or image density detecting means.

Japanese Laid-open Patent Application 2001-34019 discloses an image forming apparatus having an optical sensor which detects the amount of the toner having adhered to the latent patch image, and a toner density sensor which detects the toner density of the developer in a developing device. According to the invention disclosed in Japanese Laid-open Patent Application 2001-34019, all that is disclosed is that the amount by which toner is supplied based on the results of the detection by the optical sensor is adjusted with the use of the results of the detection by the toner density sensor. In other words, the image forming apparatus in accordance with the invention disclosed in Japanese Laid-open Patent Application 2001-34019 is not an image forming apparatus having multiple image formation modes which make it possible to selectively use the toner density detecting means or image density detecting means to control the amount by which toner is supplied to a developing device.

SUMMARY OF THE INVENTION

The primary object of the present invention is to provide an image forming apparatus capable of controlling the amount by which toner is supplied, according to the image formation mode.

According to an aspect of the present invention, there is provided an image forming apparatus comprising a first developing device for developing an electrostatic image with a developer including toner and carrier; a second developing device for developing an electrostatic image with a developer including toner which is different from the toner and carrier; first supplying means for supplying the toner into said first developing device; second supplying means for supplying the toner into said second developing device; toner content detecting means for detecting a toner content in the developer in said first developing device; image density detecting means for detecting an image density of a reference toner image formed using said first developing device and said second developing device; and, control means for operating said apparatus selectively in, a first mode in which an image forming operation is carried out using only said first developing device out of said first developing device and said second developing device, and said first supplying means supplies the toner using at least a detection result of said toner content detecting means, and a second mode in which an image forming operation is carried out using said first developing device and said second developing device, and said first supplying means and said second supplying means supply the toner using at least a detection result of said image density detecting means, wherein a frequency of formations of said reference toner images when the toner is supplied using both of the detection results of said toner content detecting means and said image density detecting means, in said first mode, is lower than a frequency of formations of said reference toner images in said second mode.

According to another aspect of the present invention, there is provided an image forming apparatus comprising a first developing device for developing an electrostatic image with a developer including toner and carrier; a second developing device for developing an electrostatic image with a developer including toner which is different from the toner and carrier; first supplying means for supplying the toner into said first developing device; second supplying means for supplying the toner into said second developing device; toner content detecting means for detecting a toner content in the developer in said first developing device; image density detecting means for detecting an image density of a reference toner image formed using said first developing device and said second developing device; and, control means for operating said apparatus selectively in, a first mode in which an image forming operation is carried out using only said first developing device out of said first developing device and said second developing device, and said first supplying means supplies the toner using a detection result of said toner content detecting means without using said image density detecting means, and a second mode in which an image forming operation is carried out using said first developing device and said second developing device, and said first supplying means and said second supplying means supply the toner using a detection result of said image density detecting means without using said toner content detecting means.

According to a further aspect of the present invention, there is provided an image forming apparatus comprising a first developing device for developing an electrostatic image with a developer including toner and carrier; a second developing device for developing an electrostatic image with a developer including toner which is different from the toner and carrier; first supplying means for supplying the toner into said first developing device; second supplying means for supplying the toner into said second developing device; toner content detecting means for detecting toner contents in said first developing device and said first developing device; image density detecting means for detecting an image density of a reference toner image formed using said first developing device and said second developing device; and control means for operating said apparatus selectively in, a first mode in which an image forming operation is carried out using said first developing device and said second developing device, and said first supplying means and said second supplying means supply the toner using at least a detection result of said toner content detecting means, and a second mode in which an image forming operation is carried out using said first developing device and said second developing device, and said first supplying means and said second supplying means supply the toner using at least a detection result of said image density detecting means, wherein a frequency of formations of said reference toner images when the toner is supplied using both of the detection results of said toner content detecting means and said image density detecting means, in said first mode, is lower than a frequency of formations of said reference toner images in said second mode.

According to a further aspect of the present invention, there is provided an image forming apparatus comprising a first developing device for developing an electrostatic image with a developer including toner and carrier; a second developing device for developing an electrostatic image with a developer including toner which is different from the toner and carrier; first supplying means for supplying the toner into said first developing device; second supplying means for supplying the toner into said second developing device; toner content detecting means for detecting toner contents in said first developing device and said first developing device; image density detecting means for detecting an image density of a reference toner image formed using said first developing device and said second developing device; and control means for operating said apparatus selectively in a first mode in which an image forming operation is carried out using said first developing device and said second developing device, and said first supplying means and said second supplying means supply the toner using a detection result of said toner content detecting means without using said image density detecting means, and a second mode in which an image forming operation is carried out using said first developing device and said second developing device, and said first supplying means and said second supplying means supply the toner using a detection result of said image density detecting means without using; said toner content detecting means.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Hereafter, the image forming apparatuses in accordance with the present invention will be described in more detail with reference to the appended drawings.

Embodiment 1

[General Structure and Operation of Image Forming Apparatus]

Figure 1:
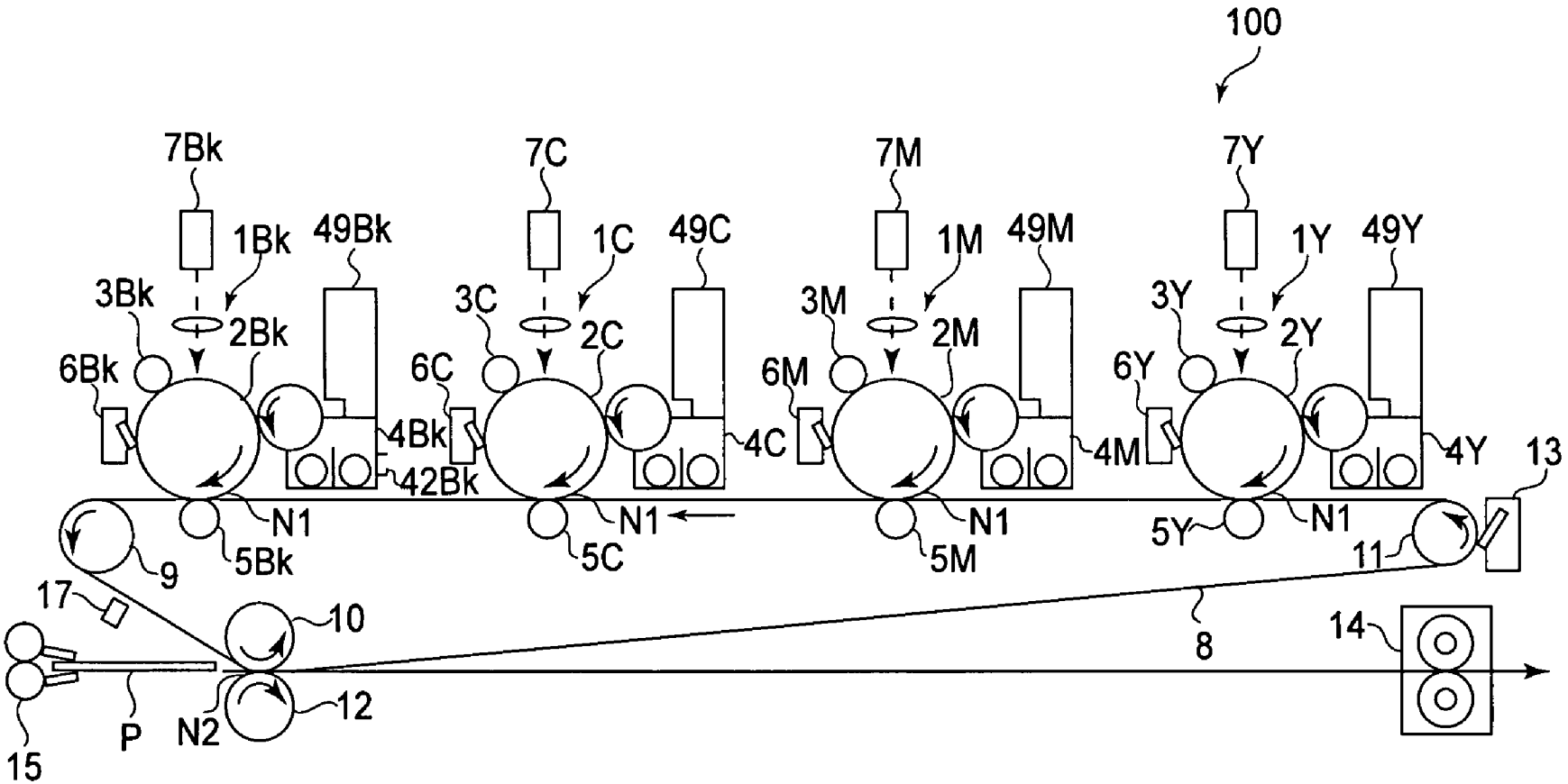
FIG. 1 is a schematic sectional view of the image forming apparatus according to a first embodiment of the present invention, showing the general structure thereof.

First, referring to FIG. 1, the general structure and operation of the image forming apparatus 100 in this embodiment will be described. The image forming apparatus 100 in this embodiment is an electrophotographic full-color printer having four image formation stations 1Y, 1M, 1C, and 1 Bk (first, second, third, and fourth image formation stations) which correspond to four colors, that is, yellow, magenta, cyan, and black colors. The image forming apparatus 100 can form a full-color image on recording medium (recording paper, plastic film, fabric, etc.) in response to video signals sent from one of the following devices connected to the main assembly of the image forming apparatus 100. The above-mentioned devices connectible to the main assembly are external devices such as an original reading apparatus (unshown), a host device such as a personal computer, a digital camera, and the like.

The image forming apparatus 100 transfers the toner images formed on the cylindrical photosensitive members as image bearing members, that is, photosensitive drums 2Y, 2M, 2C, and 2Bk, in the first—fourth image formation stations 1Y, 1M, 1C, and 1Bk, respectively, onto an intermediary transfer belt 8 as an intermediary transfer member. Then, it forms the intended image by transferring the toner images on the intermediary transfer belt 8 onto a sheet of recording medium P.

Incidentally, in the following descriptions of the preferred embodiments of the present invention, each of the elements which the four image formation stations 1Y, 1M, 1C, and 1Bk have in common is given a reference symbol made up of a numerical prefix portion common among the four image formation stations and a suffix portion indicating the color to which the common element belongs. Further, when it is unnecessary to separately describe each of the common elements, each of the suffix portions Y, M, C, and Bk of the reference symbols, which is suffixed to the common portion to indicate the color to which the common element belongs is eliminated to indicate that the description of a given common element is applicable to any of the common elements having the common reference numerals and characters.

In the image formation station 1, the cylindrical photosensitive member as an image bearing member, that is, the photosensitive drum 2, is disposed. The photosensitive drum 2 is rotationally driven in the direction indicated by an arrow in the drawing.

In the adjacencies of the peripheral surface of the photosensitive drum 2, a charge roller 3 as a charging means, a developing device 4 as a developing means, a primary transfer roller 5 as a primary transferring means, and a cleaning apparatus 6 as a cleaning means are disposed. Above (with reference to drawing) the photosensitive drum 2, a laser scanner 7 (exposing apparatus) as an exposing means is disposed. Further, the intermediary transfer belt 8 as an intermediary transfer member is disposed in a manner to oppose the photosensitive drum 2 of the image formation station 1. The intermediary transfer belt 8 is stretched around a driver roller 9, a belt-backing roller 10 (which opposes secondary transfer roller), and a follower roller 11, and is circularly moved in the direction indicated by an arrow by the driving force transmitted to the driver roller 9. The intermediary transfer belt 8 contacts the photosensitive drum 2, forming the primary transfer station N1 (primary transfer nip), in the area in which the primary transfer roller 5 opposes the photosensitive drum 2. Further, a secondary transfer roller 12 as a secondary transferring means is disposed in a manner to oppose the belt-backing roller 10, with the intermediary transfer belt 8 disposed between the two rollers 12 and 10. The secondary transfer roller 12 contacts the intermediary transfer belt 8, forming a secondary transfer station N2 (secondary transfer nip), in the area in which it opposes the belt-backing roller 10.

In this embodiment, the image forming apparatus 100 is provided with a full-color image formation mode in which it can form full-color images with the use of all of the first—fourth image formation stations 1Y, 1M, 1C, and 1Bk, and a monochromatic image formation mode in which black monochromatic images are formed with the use of only the fourth image formation station 1Bk.

First, the image forming operation carried out in the full-color image formation mode will be described. As the image forming operation begins, the photosensitive drums 2Y, 2M, 2C, and 2Bk rotate in the image formation stations 1Y, 1M, 1C, and 1Bk, and the surfaces of the rotating photosensitive drums 2Y, 2M, 2C, and 2Bk are uniformly charged by the charge rollers 3Y, 3M, 3C, and 3Bk, respectively. During this stage, charge biases are applied to the charge rollers 3Y, 3M, 3C, and 3*bk* by a charge bias power source.

Next, beams of laser light are emitted, while being modulated with video signals reflecting the primary colors which correspond one-for-one to the image formation stations, from exposing apparatuses 7Y, 7M, 7C, and 7Bk, exposing thereby the photosensitive drums 2Y, 2M, 2C, and 2Bk according to the image information reflecting the primary colors into which the optical image of the intended image have been separated. As a result, electrostatic images (latent images), which reflect the video signals, are formed on the photosensitive drums, one for one.

The electrostatic images formed on the photosensitive drums 2Y, 2M, 2C, and 2Bk are developed into toner images with the toners stored in the developing devices 4Y, 4M, 4C, and 4Bk, respectively. In this embodiment, a reversal developing method is employed as the developing method. Therefore, the toner from the developing device 4 adheres to the exposed points on the photosensitive drum 2.

The toner images formed on the photosensitive drums 2Y, 2M, 2C, and 2Bk are sequentially transferred (primary transfer) in layers onto the intermediary transfer belt 8 in the primary transfer stations N1. During this stage, primary transfer biases, the polarities of which are opposite to the normal polarity of the toner, are applied to the primary transfer rollers 5Y, 5M, 5C, and 5Bk from a primary transfer bias power source. As a result, a single multicolor image is effected on the intermediary transfer belt 8, by the four toner images, each being different in color. As for the toners (primary transfer residual toners) remaining on the surfaces of the photosensitive drums 2Y, 2M, 2C, and 2Bk are recovered by the cleaning apparatuses 6Y, 6M, 6C, and 6Bk, respectively.

Meanwhile, the recording mediums P are conveyed one-by-one in synchronization with the movement of the toner images on the intermediary transfer belt 8, from recording medium storage cassettes (unshown) in which the recording mediums P are stored).

The toner images multilayered on the intermediary transfer belt 8 are transferred all at once (secondary transfer) onto the recording medium P in the secondary transfer station N2. During this stage, the secondary transfer bias, the polarity of which is opposite to the normal polarity of the toner, is applied to the secondary transfer roller 12 from a secondary transfer bias power source.

Next, the recording medium P is conveyed to a fixing apparatus 14 as a fixing means by conveying members and the like. In the fixing apparatus 14, the toner on the recording medium P is subjected to heat and pressure, being thereby melted and mixed. As a result, the toner on the recording medium P is fixed to the recording medium P; a permanent full-color image is yielded. Thereafter, the recording medium P is discharged from the main assembly of the image forming apparatus. As for the toner (secondary transfer residual toner) remaining on the intermediary transfer belt 8 after the secondary transfer, that is, the toner which is not transferred onto the recording medium P in the secondary transfer station N2, is recovered by an intermediary transfer belt cleaner 13.

Next, the image forming operation carried out in the monochromatic image formation mode will be described. In the monochromatic image formation mode, a toner image is formed only in the fourth image formation station 1Bk; a toner image is formed on only the photosensitive drum 2Bk. Then, after this toner image is transferred (primary transfer) onto the intermediary transfer belt 8, it is transferred (secondary transfer) onto the recording medium P. The formation of a toner image in the fourth image formation station 1Bk, the primary transfer, and the secondary transfer, in this image formation operation are the same as those carried out in the above-mentioned full-color image formation mode.

Incidentally, the monochromatic image formation mode in this embodiment is described as the monochromatic image formation mode for forming black monochromatic images. However, the application of the present invention is not limited to the monochromatic image formation mode in which black monochromatic images are formed. In other words, the present invention is also compatible with any monochromatic image formation mode in which one of the image formation stations other than the image formation station for forming black monochromatic images is used. Further, the image forming apparatus 100 may be provided with an image formation mode in which two or more (not all of them) among the multiple image formation stations are used in combination to form images.

[Developing Device]

Next, referring to FIGS. 2 and 3, the developing device 4 and the toner supplying apparatus 49 for supplying the developing device 4 with toner will be described. In this embodiment, only the developing device 4Bk of the fourth image formation station 1Bk (which hereafter will be referred to as black developing device) is provided with a toner density detecting means for detecting the toner density of the developer in the black developing device. The developing devices 4Y, 4M, and 4C of the first—third image formation stations 1Y, 1M, and 1C (which hereafter will be referred to as "color developing devices") are not provided with a toner density detecting means. This setup will be described later in detail.

Figure 2:
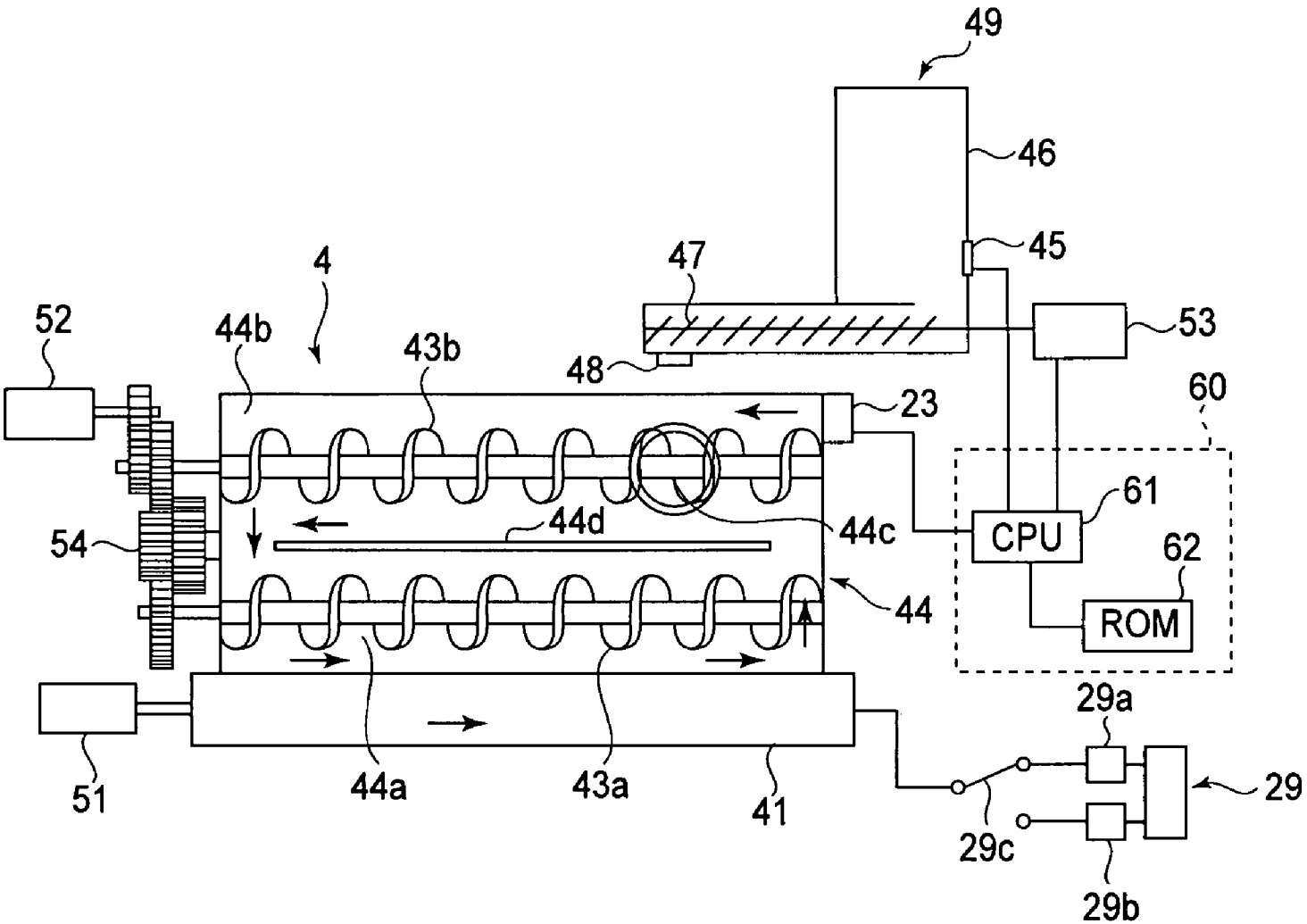
FIG. 2 is a drawing showing the developing device and toner replenishing apparatus employed by the image forming apparatus in the first embodiment of the present invention.
Figure 3:
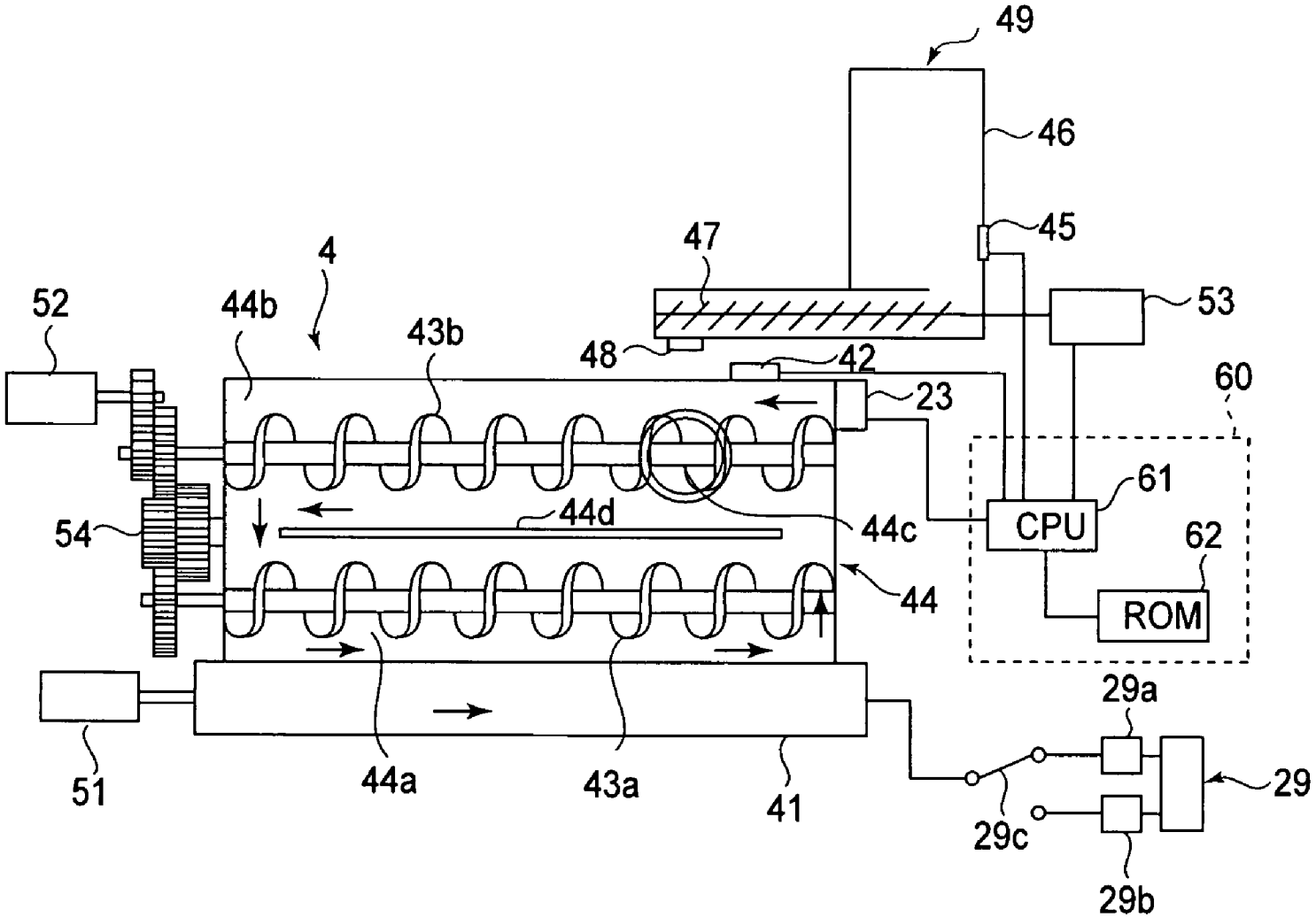
FIG. 3 is a drawing showing the developing device and toner replenishing apparatus employed by the image forming apparatus in the first embodiment of the present invention.

In this embodiment, the color developing devices 4Y, 4M, and 4C have the structure shown in FIG. 2. Also in this embodiment, the black developing device 4Bk has the structure shown in FIG. 3. In this embodiment, the color developing devices 4Y, 4M, and 4C are identical in structure. Also in this embodiment, all the toner supplying apparatuses 49 are identical in structure. In FIGS. 2 and 3, the developing device 4 is presented in the form of a plan view as seen from above in FIG. 1, and the toner supplying apparatus 49 is presented in the form of a sectional view thereof as seen from the direction parallel with the axial line of the photosensitive drum 2 (direction perpendicular to direction in which surface of photosensitive drum 2 moves).

First, the structural features which are common among the color developing devices 4Y, 4M, and 4C and black developing device 4Bk will be described.

The developing device 4 has a developing means container 44 (main assembly of developing device) in which two-component developer (developer) primarily made up of nonmagnetic toner particles (toner) and magnetic carrier particles (carrier). In the developing means container 44, two screws as stirring-and-conveying means, more specifically, a first stirring-and-conveying screw 43*a* and a second stirring-and-conveying screw 43*b*, are disposed. The developing means container 44 has an opening which faces the photosensitive drum 2 and partially exposes the development sleeve 41 as a developer bearing member, which is rotatably disposed in the developing means container 44. In the hollow of the development sleeve 41, a magnetic roll (unshown) as a magnetic field generating means is stationarily disposed. The magnetic roll has multiple magnetic poles, which are distributed in the circumferential direction of the roll. Its magnetic force attracts the developer in the developing means container 44, not only causing the developer to be borne on the development sleeve 41, but also, causing the developer to crest (form a magnetic brush) in the area (development station) in which it opposes the photosensitive drum 2.

The development sleeve 41, the first stirring-and-conveying screw 43*a*, and second stirring-and-conveying screw 43*b* are disposed in parallel. Further, the development sleeve 41, first stirring-and-conveying screw 43*a*, and second stirring-and-conveying screw 43*b* are disposed in parallel with the axial line of the photosensitive drum 2. The developing means container 44 has a first chamber 44*a* (development chamber) and a second chamber 44*b* (stirring chamber), which are separated from the first chamber 44*a* by a partitioning wall 44*d*. The development chamber 44*a* and stirring chamber 44*b* are connected to each other at both of the lengthwise ends of the developing means container 44 (left and right ends in FIGS. 2 and 3).

The first stirring-and-conveying screw 43*a* is disposed in the development chamber 44*a*, and the second stirring-and-conveying screw 43*b* is disposed in the stirring chamber 44*b*. These first and second stirring-and-conveying screws 43*a* and 43*b* are rotationally driven in the same direction by the rotation of a motor 42, which is transmitted through a gear train 54. As they are rotated, the developer in the stirring chamber 44*b* is moved leftward of FIGS. 2 and 3 by the second stirring-and-conveying screw 43*b* while being stirred by the screw 43*b*, and then, moves into the development chamber 44*a* through the connective portion. The developer in the development chamber 44*a* is moved rightward of FIGS. 2 and 3 by the first stirring-and-conveying screw 43*a* while being stirred by the screw 43*a*, and moves into the stirring chamber 44*b* through the connective portion. In other words, the developer is circularly moved through the developing means container 44 by the first and second stirring-and-conveying screws 43*a* and 43*b* while being stirred by the two screws 43*a* and 43*b*.

As the developer is circularly moved while being stirred as described above, the toner in the developer is given an electric charge. In this embodiment, toner is supplied into the developing means container 44 through a toner replenishment hole 44*c*, with which the top portion of the stirring chamber 44*b* is provided. In terms of the direction in which the developer is conveyed in the stirring chamber 44*b*, the toner replenishment hole 44*c* is located upstream end of the stirring chamber 44*b*. The right-hand end (in drawing) of the stirring chamber 44*b* is also provided with a window, through which the state of the interior of the stirring chamber 44*b* can be observed.

The development sleeve 41 is rotationally driven by a motor 51 in the direction (counterclockwise direction) indicated by the arrow mark in the drawing. The rotation of the development sleeve 41 causes the developer to be coated in a uniform layer by a regulator blade (unshown), and conveyed to the development station where the layer of developer opposes the photosensitive drum 2. In the development station, the developer on the development sleeve 41 is caused to crest by the magnetic force of the magnetic roller, forming a magnetic brush, which is in contact, or virtually in contact, with the surface of the photosensitive drum 2. Then, toner is supplied to the electrostatic image on the photosensitive drum 2 from the developer which has been conveyed to the development station through the above-described process. As toner is supplied to the electrostatic image on the photosensitive drum 2, toner selectively adheres to numerous points of the electrostatic image, developing thereby the electrostatic image into a visible image, that is, an image formed of toner (which hereafter will be referred to simply as toner image). To describe in more detail, when the electrostatic image on the photosensitive drum 2 reaches the development station, development bias, which is a combination of AC and DC voltages, is applied to the development sleeve 41 from a development bias power source (unshown). During this process, the development sleeve 41 is being rotationally driven in the direction indicated by the arrow in the drawing by the motor 51, and the toner in the developer is transferred onto the photosensitive drum 2 by the above-mentioned development bias, in accordance with the electrostatic image on the surface of the photosensitive drum 2.

The toner in the two-component developer is consumed through a developing operation such as the above-described one, causing the toner density of the developer in the developing means container 44 to gradually fall. Therefore, toner is supplied to the developing means container 44 by the toner supplying apparatus 49 as a supplying means. The toner supplying apparatus 49 has a toner container 46 (replenishment toner container, replenishment toner storage portion) in which the toner to be supplied to the developing device 4 is stored. The bottom left end (in drawing) of the replenishment toner container 46 is provided with a toner discharge hole 48, which is connected to the toner replenishment hole 44*c* of the developing device 4. The replenishment toner container 46 is also provided with a toner supplying screw 47 as a toner supplying member which conveys the toner toward the toner discharge hole 48. The toner supplying screw 47 is rotationally driven by a motor 53.

The rotation of the motor 53 is controlled by the CPU 61 (controlling means) of an engine control portion 60 with which the main assembly of the image forming apparatus is provided. The relationship between a unit length of time the toner supplying screw 47 is rotated when a preset amount of toner is in the toner container 46, and the amount by which the toner is to be supplied by the toner supplying screw 47 into the developing means container 44 through the toner discharge hole 48 (toner replenishment hole 44*c*), has been obtained in advance by tests or the like. The results of these tests or the like are stored in the form of a table, in a ROM 62 connected to the CPU 61 (or CPU 61 itself). In other words, the CPU 61 adjusts the amount by which toner is to be supplied to the developing means container 44, by controlling (adjusting) the length of time the motor 53 is rotated. This method of controlling the amount by which toner is supplied will be described later in detail.

Further, in this embodiment, the developing device 4 is provided with an information storing apparatus 23. In this embodiment, a RP-ROM, which is a rewritable storage means, is used as the image formation storing apparatus 23. Setting of the developing means container 44 in the image forming apparatus 100 establishes electrical connection between the information storing means 23 and CPU 61, making it possible for the main assembly of the image forming apparatus 100 to read the processed image formation information from the information storing apparatus 23, or write the information into the information storing apparatus 23.

The toner has resinous coloring particles and external additive particles. The resinous coloring particles contain bonding resin, coloring agent, and additives (which are added as necessary). The external additive particles are microscopic particles such as microscopic particles of choroidal silica. The toner is formed of polyester resin produced by polymerization. It is negatively chargeable. Its volume average particle diameter is desired to be no less than 5 μm and no more than 8 μm. In this embodiment, the volume average particle diameter of the toner is 6.2 μm.

As the carrier, particles formed of a metallic substance, such as iron, nickel, cobalt, manganese, chrome, and rare-earth metals, alloys of preceding substances, ferric oxide, etc., are preferably usable. They may be oxidized or not oxidized across their surfaces. The method for manufacturing these magnetic particles does not need to be limited to a specific one. The weight average particle diameter of the carrier is desired to be 20-50 μm, preferable, 30-40 μm, and the resistivity of the carrier is desired to be no less than $10^8$ Ω·cm. In this embodiment, one of the above-mentioned substances, the resistivity of which is $10^8$ Ω·cm, was used as the carrier. In this embodiment, magnetic carrier which is low in specific weight is used. It is resinous magnetic carrier, which is a mixture of phenolic resin as a binder, oxides of magnetic metals, and oxides of nonmagnetic metals. It is manufactured by polymerization. The carrier used in this embodiment is 35 μm in volume average particle diameter, 3.6-3.7 g/cm$^3$ in true density, and 53 A·m$^2$/kg in the amount of magnetization.

Also in this embodiment, among the four developing devices 4Y, 4M, 4C, and 4Bk, the black developing device 4Bk has a toner density detecting means, in addition to the above-described structure. More specifically, the black developing device 4Bk has a permeability sensor 42 as a toner density detecting means for detecting the toner density of the developer. The permeability sensor 42 is disposed within the stirring chamber 44*b*, as shown in FIG. 3. In this embodiment, the permeability sensor 42 is attached to one of the side walls of the developing means container 44, being on the upstream side of the toner replenishment hole 44*c* in terms of the direction in which the toner is conveyed in the stirring chamber 44*b*.

Assuming that the point of the developing means container 44, to which the toner is delivered from the toner supplying apparatus 49, is on the most upstream side of the developing means container 44, in terms of the developer circulation. The point of the internal surface of the developing means container 44, to which the toner density detection sensor is attached, is on the most downstream side. In other words, the toner density detection sensor 42 is positioned so that it detects the toner density of the developer in the developing means container 44 at the location where the developer is in the most stirred state.

[Toner Replenishment Control]

In this embodiment, only the black developing device is provided with the permeability sensor 42 as a toner density detecting means. In the monochromatic image formation mode, both the inductance-based density detecting method and patch-based density detecting method are used to control the toner replenishment. However, the color developing devices 4Y, 4M, and 4C are not provided with the toner density detecting means. Therefore, the toner replenishment thereto is controlled with the use of only the patch-based density detecting method.

The inductance-based density detecting method can directly detect the toner density of the developer in a developing device, as described above. Therefore, the inductance-based density detecting method makes it relatively easy to keep the toner density constant. Further, it is advantageous in that even if the toner density is very frequently detected, the downtime does not occur. On the other hand, it suffers from the following disadvantages. That is, if the amount by which toner is electrically charged drastically changes due to prolonged or continuous usage of the developer, changes in the ambience in which developer is used, or if the amount by which toner is electrically charged changes due to carrier deterioration, the amount of the force which keeps toner particles bonded with carrier particles changes, which in turn changes the amount by which toner particles transfers onto a photosensitive member, making it difficult to keep an image forming apparatus stable in terms of image density and color tone.

In comparison, what is detected by the patch-based density detecting method is the image density of the formed patch image (amount by which toner adheres to image bearing medium). Therefore, this method in advantageous in that even if the amount by which toner is charged changes due to the changes in ambient factors such as temperature and humidity, and/or carrier deterioration attributable to elapsed time, the image density with which the image forming apparatus forms images can be always kept at a proper level, preventing therefore the color tone in which the image forming apparatus forms images, from varying. Further, this method makes it unnecessary to provide the developing means container with an internal toner density detection sensor, being therefore advantageous in terms of cost. On the other hand, from the standpoint of increasing the speed of the image forming apparatus, that is, increasing the output of the image forming apparatus per unit of time, the downtime which occurs when forming the patch images sometimes becomes problematic.

Generally, the frequency with which an image forming apparatus is used for forming black monochromatic images is much higher than that for forming full-color images. Therefore, preventing the occurrence of the downtime is extremely important to keep the productivity of an image forming apparatus at a high level.

Further, the frequency with which the black developing device is used is very high. Therefore the life of the developer in the black developing device must be very long. To describe this subject in more detail, the amount by which the toner in the developer is electrically charged drastically changes due to prolonged or continuous usage of the developer, and also, due to changes in the ambient factors in which developer is used. Thus, if the toner replenishment is controlled without directly detecting the toner density of the developer in a developing device, the toner density of the developer in the developing device sometimes drastically changes. In other words, if the amount by which toner is supplied is controlled by the patch-based density detecting method or the like to keep at a proper level the image density with which the image forming apparatus forms image, the amount by which the toner is electrically charged may drastically change even if the image density is at the proper level. If the toner density drastically changes, the load to which the developer is subjected increases, making it easier for problems such as the formation of foggy images, carrier adhesion, scattering of toner, and the like to occur. Therefore, it is very important to prevent as much as possible the deterioration of the developer, which occurs in a very frequently used developing device, typically, a black developing device, due to the changes in the toner density in the developer in the developing device.

On the other hand, the frequency with which full-color images are formed is lower than that with which black monochromatic images are formed. Further, generally, when forming full-color images, it is very important to keep at a proper level the image density with which an image forming apparatus forms images, and also, to prevent from changing the color tone with which an image forming apparatus forms images.

According to the present invention, therefore, when high productivity is the priority (monochromatic image formation mode in this embodiment), the toner replenishment is controlled primarily with the use of the toner density detecting method, whereas when high image quality (stability in image density and color tone) is the priority (full-color image formation mode in this embodiment), the toner replenishment is controlled with the use of primarily the image density detecting method. The frequency with which patch images are formed in the mode in which image density detecting method is primarily used as the toner replenishment controlling method is higher (in other words, greater in the number of patch images formed per unit number of image outputs) than that in the mode in which the toner density detecting method is primarily used as the toner replenishment controlling method.

In this embodiment, only the black developing device 4Bk is provided with the permeability sensor 42 as described above. When the image forming apparatus 100 is used in the monochromatic image formation to form black monochromatic images, the toner replenishment for the black developing device 4Bk is controlled with the use of the inductance-based density detecting method. With the usage of this method, keeping the image forming apparatus at a high level of productivity is prioritized. At the same time, the developer in the developing device is prevented from changing in toner density, preventing thereby the developer in the developing device from deteriorating. Incidentally, in this embodiment, in the monochromatic image formation mode, the patch-based density detecting method is used in combination with the inductance-based density detecting method, in order to adjust the toner replenishment control based on the inductance-based density detecting method.

In comparison, when the image forming apparatus is used in the full-color image formation mode to form full-color images, the toner replenishment for all the developing devices 4Y, 4M, 4C, and 4Bk, that is, yellow, magenta, cyan, and black developing devices, respectively, is controlled with the use of the patch-based density detecting means; the inductance-based density detecting method is not used. With the usage of this method, keeping the image density with which the image forming apparatus forms images in all the primary colors, always at a proper level, and preventing the image forming apparatus from changing in the color tone with which it forms images, are prioritized.

At this time, paying attention to the black developing device 4Bk, the image forming apparatus 100 is provided a first mode (monochromatic image formation mode) in which the amount by which toner is supplied to the black developing device 4Bk from the supplying means 49Bk (toner supplying means for black developing device 4Bk) is controlled with the use of at least the toner density detecting means 42Bk (permeability sensor). The image forming apparatus 100 is also provided with a second mode (full-color image formation mode) in which the amount by which toner is supplied to the black developing 4Bk from the supplying means 49Bk is controlled with the use of at least the image density detecting means 17 (image density sensor). Further, the image forming apparatus 100 is structured so that even when the amount by which toner is supplied to the black developing device 4Bk from the supplying means 49Bk in the first mode is controlled with the use of the image density detecting means 17 along with the toner density detecting means 42Bk, the frequency with which the standard toner images (patch images formed of only black toner) are formed in the second mode is higher than that in the first mode.

Next, paying attention to both the black developing device 4Bk (first developing device) and color developing devices (second developing devices) 4Y, 4M, and 4C, it is assumed that in the image forming operation which will be described next, only the black developing device 4Bk among the black developing device 4Bk and color developing devices 4Y, 4M, and 4C is used for image formation. In this case, the first mode (monochromatic image formation mode) in which the amount by which toner is supplied to the black developing device 4Bk from the first supplying apparatus 49Bk (toner supplying apparatus for black developing device) is controlled with the use of at least the toner density detecting means 42Bk is carried out. Next, an image forming operation in which images are formed with the use of both the black developing device 4Bk and color developing devices 4Y, 4M, and 4C is described. In this case, the second mode (full-color image formation mode) in which the amounts by which toners are supplied to the black developing device 4Bk and color developing devices 4Y, 4M, and 4C from the first supplying means 49Bk and second supplying means 49Y, 49M, and 49C (toner supplying apparatuses for color developing devices 4Y, 4M, and 4C), respectively, are controlled with the use of at least the image density detecting means 17 (image density sensor), is carried out. The image forming apparatus is designed so that even when the amount by which toner is supplied to the black developing device 4Bk from the first supplying means 49Bk is controlled in the first mode with the use of the toner density detecting means 42Bk and image density detecting means 17, the frequency with which the standard toner images (patch images formed of black toner) in the second mode is higher than that in the first mode. Next, this subject will be described in more detail.

[Inductance-based Density Detecting Method]

First, the method for controlling the amount by which toner is supplied, with the use of the inductance-based density detecting method, will be described. In this embodiment, the inductance-based density detecting method is used only for controlling the amount by which toner is supplied to the black developing device 4Bk.

The amount of the toner in the developing means container 44 of the black developing device 4Bk is reduced by an image forming operation, reducing thereby the toner density in the developer. In this embodiment, the developing means container 44 of the black developing device 4Bk is provided with the permeability sensor 42 to detect the permeability of the developer in the developing means container 44 and thereby to detect the toner density of the developer in the developing means container 44. The smaller the toner density in the developer, the larger the carrier ratio, and therefore, the greater the permeability of the developer. Therefore, the smaller the toner density in the developer, the greater the output of the permeability sensor 42.

Figure 4:
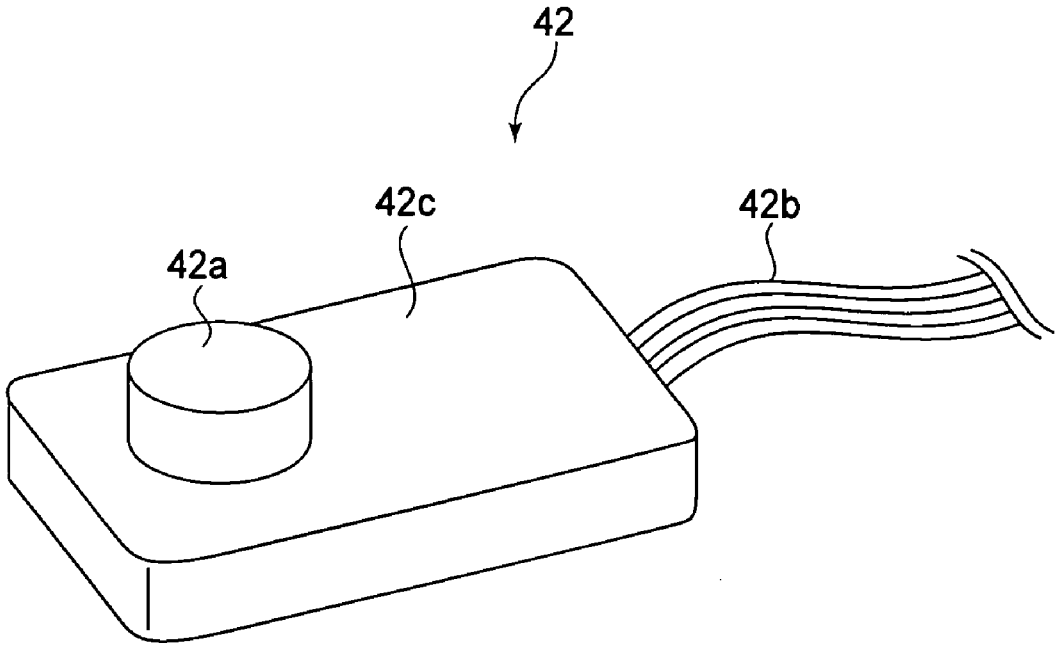
FIG. 4 is a schematic drawing of an example of a permeability sensor.

Referring to FIG. 4, the permeability sensor 42 is made up of a main assembly 42*c*, and a cylindrical detection head 42*a* mounted on the main assembly 42*c*, being thereby integrated with the main assembly 42*c*. It exchanges the detection signals and the like with a CPU 61 of an engine controlling portion 60 of a main assembly of the image forming apparatus, through an input/output signal wire 42B. The detection head 42*a* is provided with a detection transformer, which is embedded in the detection head 42*a*. This detection transformer is made up of a total of three coils, which are a single primary coil and two secondary coils (reference coil and detection coil). The detection coil is disposed on the top surface side of the detection head 42*a*, and the reference coil is disposed on the rear side of the detection head 42*a*, with the primary coil located between the two secondary coils. As electric current, the waveform of which is preset, is inputted into the primary coil from an oscillator located in the main assembly 42*c* of the sensor, electric current having a certain waveform (signal) flows through the two secondary coils, that is, the reference coil and detection coil due to magnetic induction. Then, the density of the magnetic substance on the top surface side of the main assembly 42*c* of the sensor is detected by comparing the signal from the oscillator, which is in the form of the preset waveform, with the use of an internal comparator circuit of the main assembly 42*c* of the sensor, with the electric current having the certain waveform (signal), which is electromagnetically induced in the detection coil.

Figure 5:
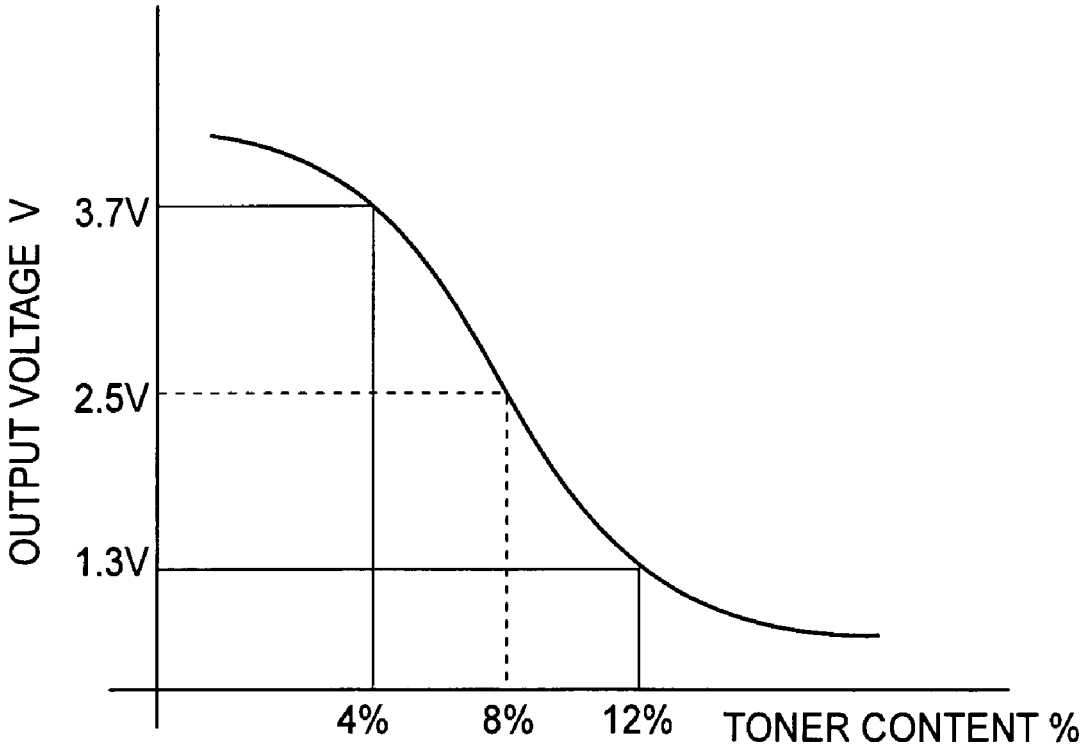
FIG. 5 is a graph showing one of the properties of the permeability sensor.

At this time, the relationship between the toner density of the developer and the output of the permeability sensor 42 will be described. FIG. 5 shows one of the examples of the properties of the output of the permeability sensor 42. In the case of the example shown in FIG. 5, when the developer is small in toner density, the output voltage becomes saturated at a large value, and as the developer increases in toner density, the sensor output gradually reduces. Further, when the developer is high in toner density, the output voltage saturates at a small value. In this embodiment, the permeability sensor 42 has been adjusted so that when the toner density is normal, that is, 8% (wt. %: hereafter, toner density will be expressed in wt. %), its electrical output in terms of voltage is 2.5 V. When the value of the output voltage is close to 2.5 V, the value of the output voltage of the permeability sensor 42 virtually linearly changes relative to the toner density. Incidentally, the target value of the permeability sensor is changed to an optimal value according to the stage of developing device usage and the ambient factors in which the developing device is used.

As described above, the toner density of the developer in the black developing device 4Bk is detected by the permeability sensor 42. Then, the toner supplying apparatus 49 in which replenishment toner is stored is driven, based on the results of the detection by the permeability sensor 42, so that the toner density of the developer in the developing means container 44 is kept constant. More specifically, the CPU 61 determines the length of time a motor 53 is to be rotated (that is, amount by which toner is to be supplied), based on the results of the detection by the permeability sensor 42, and the motor 53 is rotated for the determined length of time. In the ROM 62 (or CPU 61), information, such as that shown in FIG. 5, for determining the amount by which toner is to be supplied to the developing means container 44, based on the relationship between the detected output of the permeability sensor 42 and the toner density of the developer, is stored in the form of a data table or the like. Therefore, the CPU 61 controls the amount by which toner is to be supplied, by obtaining the number of times the toner supplying screw 47 is to be rotated, from the detected toner density and a data table such as the above-described one which shows the relationship between the length of time the motor 53 is rotated and the amount by which toner is supplied by the rotation of the motor 53.

Normally, in the toner replenishment control based on the inductance-based density detecting method, each time the image formation for a single recording medium P is completed, toner is supplied by obtaining the number of times a toner supplying screw 47 is to be rotated.

[Patch-Based Density Detecting Method]

Next, the method for controlling the amount by which toner is supplied, which uses the patch-based density detecting method, will be described.

In this embodiment, after a standard latent image (latent image of patch) prepared in advance is formed on the photosensitive drum 2, the standard toner image (referential toner image, patch image) is formed on the photosensitive drum 2 by developing the latent image under preset conditions. Then, this patch image is transferred onto the intermediary transfer belt 8. Then, the density of the patch image is detected by the image density detecting means 17 (image density sensor). The image density detecting means 17 inputs the density signals, which it outputs according to the image density (amount of toner adhesion) of the patch image, into the CPU 61. The CPU 61 compares the density signals from the image density sensor 17 with the initial standard signals stored in advance in the CPU 61, and controls the length of time the toner supplying apparatus 49 is to be driven, based on the results of the comparison. Incidentally, as the image density sensor 17, an ordinary optical sensor of the reflection type can be employed. Next, this process will be described in more detail.

First, during the initialization of the image forming apparatus 100, the ambient factors table (which contains preset values for the processing conditions to be set according to information regarding temperature and humidity, preset values for the processing conditions to be set according to exposure light intensity, development bias, transfer bias, etc.), which has been prepared in advance and stored in the ROM 62, is read. The latent image of the patch is formed by exposing the charged photosensitive drum 2 according to this table. Then, the patch image is formed by developing this latent image of the patch. This method of forming the latent image of a patch is referred to as digital patch forming method.

Incidentally, the patch image may be formed by developing the latent image of the patch (contrast in potential level) formed by utilizing the difference between the potential level of the development bias and the potential level of the photosensitive drum 2 (potential level of the area of the photosensitive drum 2 which has been charged by charge roller 3, but, has not been exposed by an exposing apparatus 7), instead of exposing the photosensitive drum 2 to the beam of laser light. This method of forming the patch image is referred to as the analog patch image forming method.

The amount by which toner is supplied is controlled in the following manner. That is, the density of the patch image formed during the initialization of the image forming apparatus 100 is detected by the image density sensor 17, as described above. Then, the value of the output signal of the image density sensor 17 is inputted as the target signal value into the CPU 61. The CPU 61 controls the amount by which toner is supplied from the toner container 46 to the developing means container 44 of the developing device 4, so that the density of the patch image formed for the toner replenishment, that is, the value of the output signal of the image density sensor 17, matches the target signal value in the CPU 16.

Incidentally, in this embodiment, a latent image formed by digital exposure is referred to as digital latent image, and an image formed by developing a digital latent image is referred to as a digital image. In comparison, a latent image formed without carrying out the above-mentioned exposing process is referred to as an analog latent image, and an image formed by developing an analog latent image is referred to as analog image, in order to ensure the distinction between the two types of image. Hereafter, these reference names will be used as necessary.

The above-mentioned digital patch image forming method suffers from the following problem. That is, the properties of the photosensitive drum 2, in particular, the photosensitivity of the photosensitive drum 2, sometimes change from those which the photosensitive drum 2 displays during the initialization of an image forming apparatus, due to the deterioration of the photosensitive drum 2 attributable to its usage, changes in ambient, and the like factors. Thus, the potential level of the photosensitive drum 2, which is achieved by exposing the photosensitive drum 2 to a beam of laser light outputted from the exposing apparatus 7, differs from the theoretical potential level set during the initialization. This difference in potential level causes the density of an image formed on the photosensitive drum 2 to differ from a preset value. If the amount by which toner is supplied is controlled based on the image density value which contains this error, the value the toner density in the developing means container 44 falls outside a preset range, making it likely for defective images, such as images which are wrong in image density and images suffering from fog, to be formed.

For cost and size reduction, some image forming apparatuses are not provided with a sensor for measuring the potential level of an photosensitive member, which is highly functional, being therefore expensive. If the amount by which toner is supplied is controlled based on the patch image formed for a toner replenishment operation, without having the above-mentioned sensor for measuring the potential level of a photosensitive member, the toner density of the developer in the developing device 4 sometimes substantially fluctuates. In such a case, the load to which the developer is subjected increases, possibly causing the problems such as the formation of an increased number of abnormal images, for example, foggy images, and/or reduction in developer life.

In this embodiment, therefore, in order to prevent the changes in the photosensitivity of the photosensitive drum 2 from causing the portion of the photosensitive drum 2, which has been exposed to a beam of laser light, to become nonuniform in potential level, the analog patch image forming method is employed. As described above, the analog patch image forming method forms a latent patch image without exposing the photosensitive drum 2 to a beam of laser light. Therefore, the resultant latent patch image is uniform in potential level. Then, this latent patch image is developed into a patch image.

Next, the development bias in this embodiment will be described. Referring to FIGS. 2 and 3, the image forming apparatus in FIG. 1 has a high voltage power supplying apparatus 29 as a development bias outputting means, which is connected to the CPU 61 as a controlling means. The high voltage power supplying apparatus 29 has two high voltage power sources (development bias application power sources), that is, first and second high voltage power sources 29*a* and 29*b*. The first high voltage power source 29*a* is capable of applying a development bias A to each developing device, and the second high voltage power source 29*b* is capable of applying a development bias B to each developing device. Further, the high voltage power supplying apparatus 29 has a development bias switching means 29*c*, which enables the high voltage power supplying apparatus 29 to selectively apply to the development sleeve 41 the output of the first or second high voltage power sources 29*a* and 29*b*. In other words, the development bias applied to the development sleeve 41 can be switched.

Figure 6:
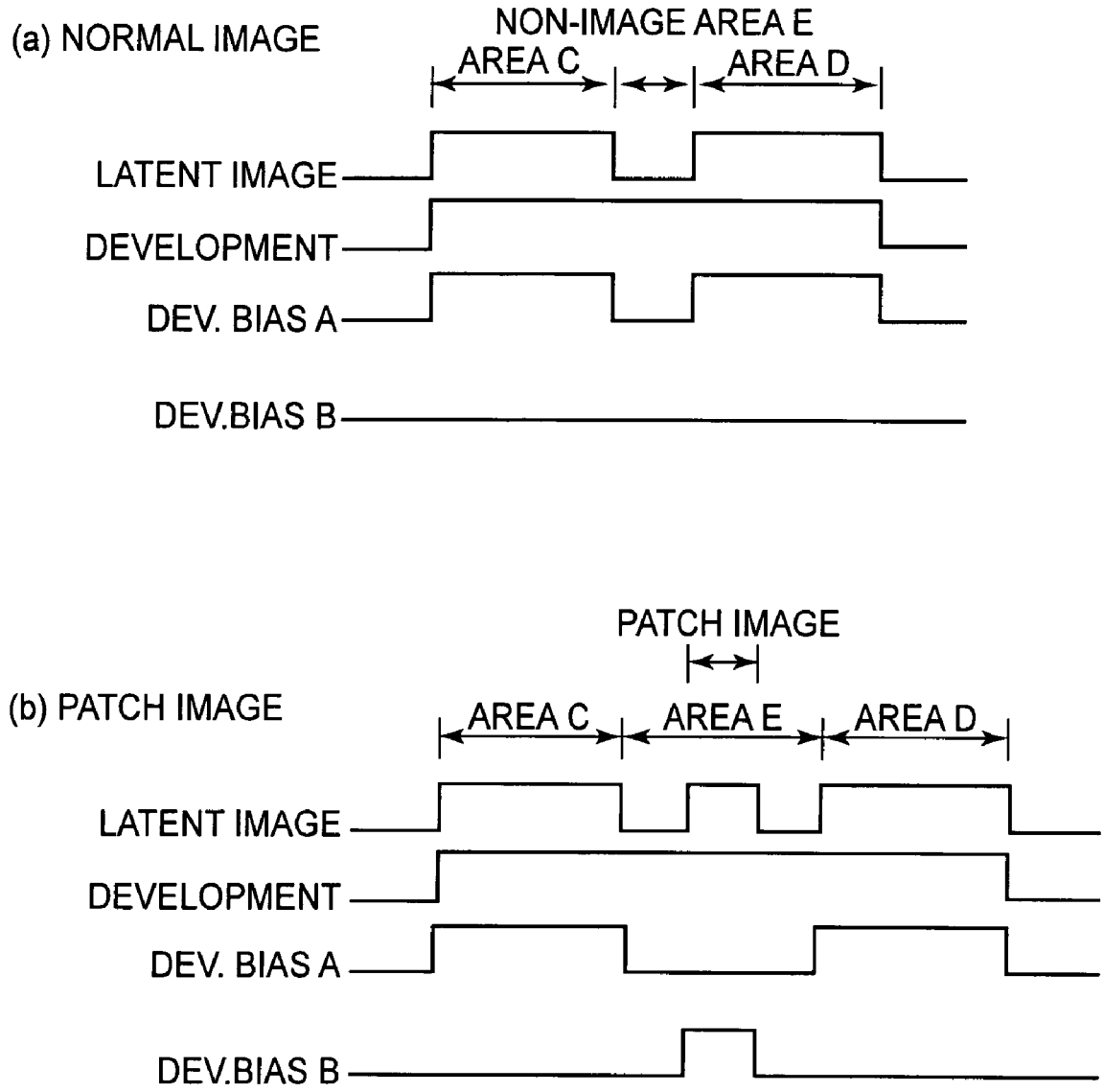
FIGS. 6(*a*) and 6(*b*) are timing charts showing the timing with which the development bias is switched.

FIGS. 6(*a*) and 6(*b*) are timing charts for the development bias applied during a normal image forming operation and a patch image forming operation, respectively. The line denoted by "latent image" in the drawing shows the period in which a latent image is being formed, and the line denoted by "development" shows the period in which the development sleeve 41 is rotating. Further, the lines denoted by "development biases A and B" show the periods in which the development biases A and B are being applied to the development sleeve 41, respectively.

Figure 7:
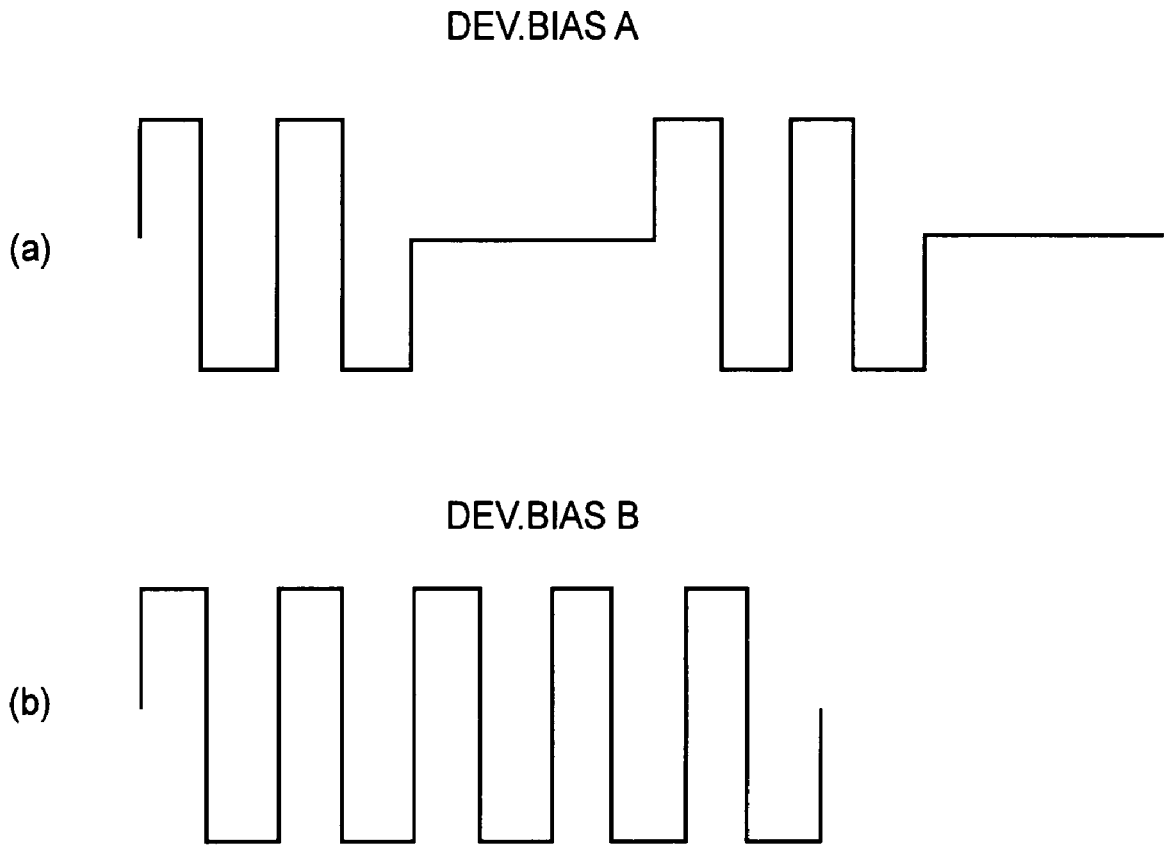
FIGS. 7(*a*) and 7(*b*) are drawings showing the waveform of the development bias A and the waveform of the development bias B, respectively.

FIGS. 7(*a*) and 7(*b*) show waveforms of the development biases A and B, respectively, which are alternating voltages applied to the development sleeve 41 (axis of abscissas shows elapsed time, and axis of ordinates shows magnitude of voltage applied to development sleeve 41).

Figure 8:
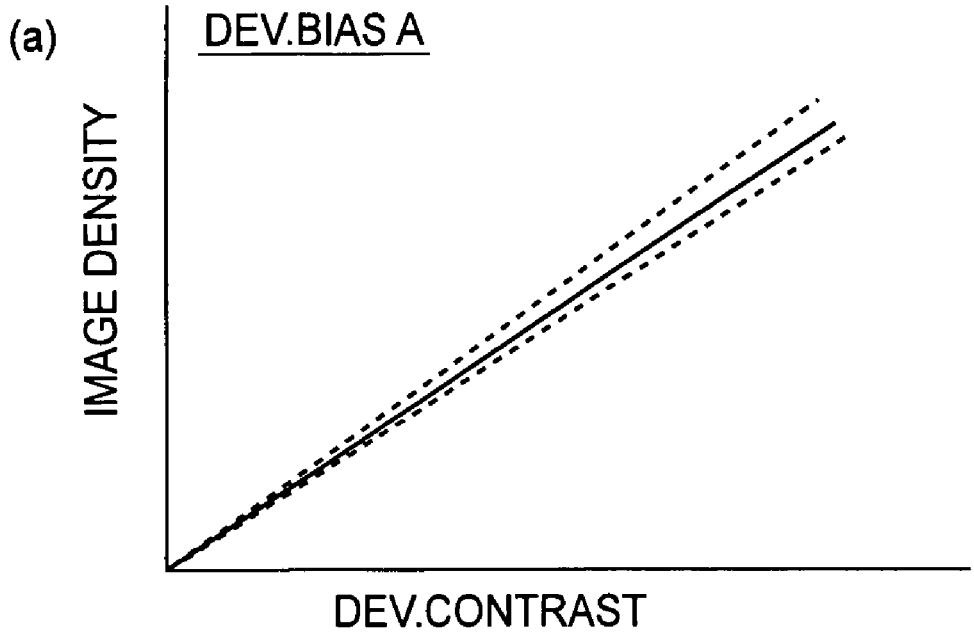
FIGS. 8(*a*) and 8(*b*) are drawings showing the development characteristics of the development bias A and the development characteristics of the development bias B, respectively.
Figure 8:
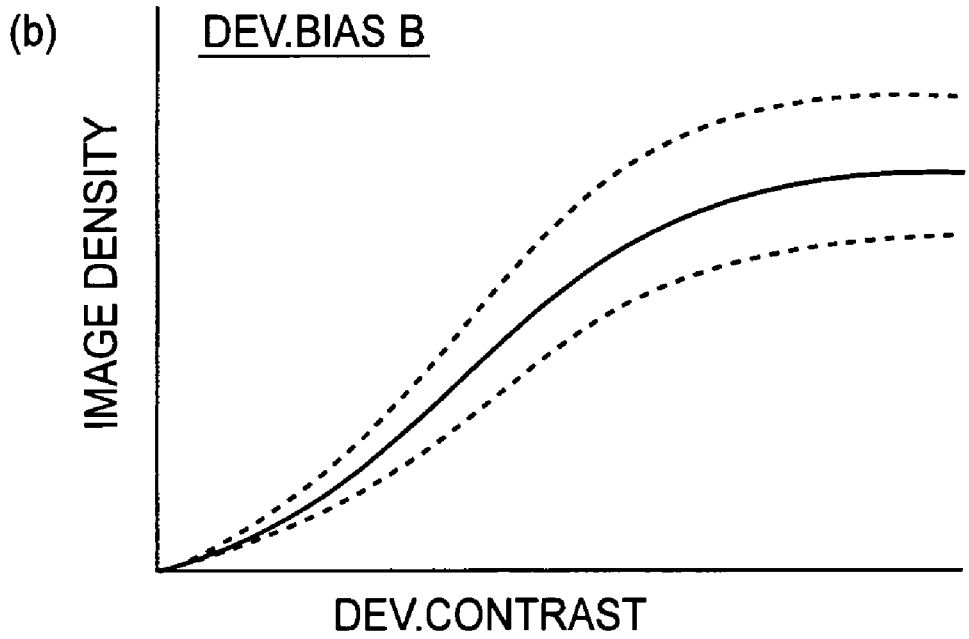

FIGS. 8(*a*) and 8(*b*) show the developmental characteristics of the development biases A and B (axis of abscissas shows development contrast (absolute value), and axis of ordinates shows image density of patch image detected by sensor).

Figure 9:
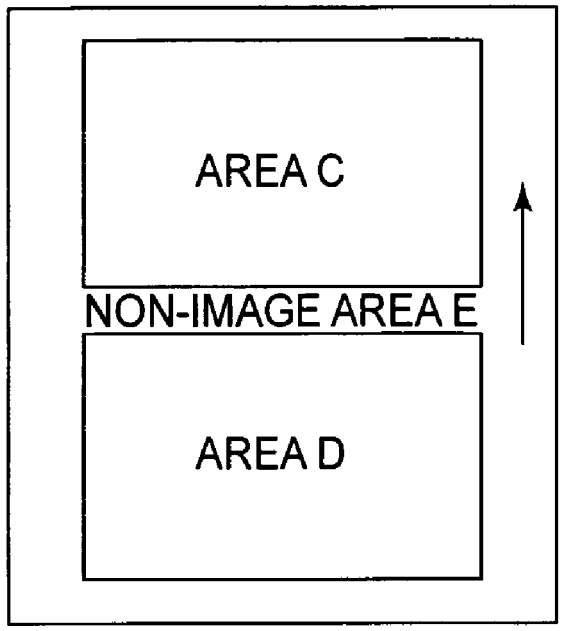
FIGS. 9(*a*) and 9(*b*) are drawings showing the area of the surface of the photosensitive drum, across which an image is formed during an image forming operation, and the area of the surface of the photosensitive drum, across which no image is formed during the image forming operation.
Figure 9:
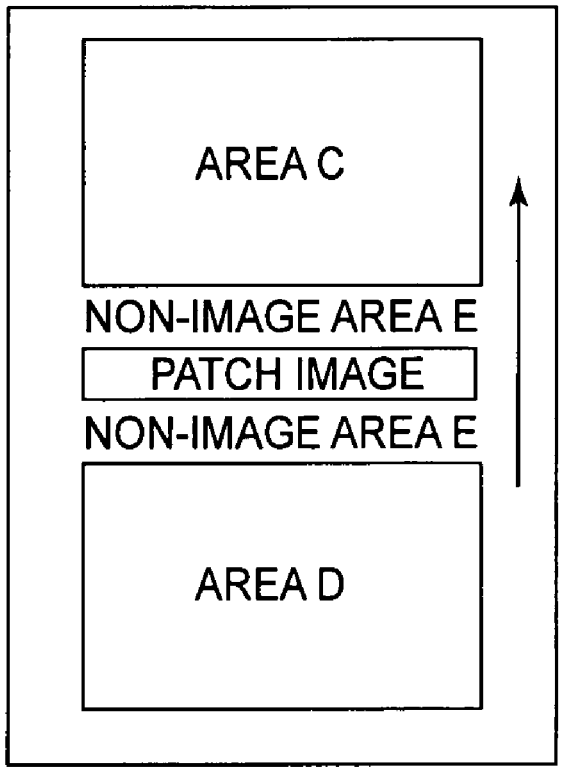

FIGS. 9(*a*) and 9(*b*) show the areas C and D of the photosensitive drum 2, across which images are formed, one-for-one, during a normal image forming operation and a patch image forming operation, in which multiple images are continuously formed on multiple recording mediums P, one-for-one. The area E of the photosensitive drum 2, which is not used for image formation during a normal image forming operation and a patch image forming operation, in which multiple images are continuously formed on multiple recording mediums P, one-for-one. Incidentally, the arrows in the drawings indicate the moving direction of the surface of the photosensitive drum 2.

In this embodiment, the amount by which toner is supplied is controlled with the use of the patch-based density detecting method. It is controlled for every preset length of time (for example, every preset number of sheets of recording medium on which image has been formed). It is controlled with a preset timing, during a period other than the period in which an image to be outputted after being recorded on the recording medium P is formed. As the preset timing outside the normal image formation period (timing within no image formation period), the period prior to the beginning of an actual image forming operation, the period after the ending of the actual image forming operation, the period corresponding to one of the recording medium intervals which occurs when multiples images are continuously formed on multiple recording mediums P one-for-one, and the like, can be listed.

Next, referring to FIG. 9, a part of an image forming operation in which multiple images are continuously formed will be described. The electrostatic latent image for forming an ordinary image to be formed is formed with the use of the digital latent image forming method, across the image formation area C of the photosensitive drum 2. As this digital latent image reaches the developing station where it faces the developing device 4, the development bias A shown in FIG. 7(*a*) is applied to the development sleeve 41 of the developing device 4. As a result, the latent image is developed. Then, before forming the latent image for forming the next normal image, the amount by which toner is supplied is controlled by forming the latent image for forming the patch image is formed across the area (no image formation area E in FIG. 9(*b*)) of the photosensitive drum 2, which is substantially greater in size than the no image formation area E (FIG. 9(*a*)) of the photosensitive drum 2, which occurs during the normal image forming operation.

More specifically, an analog latent image is formed across the no image formation area E of the photosensitive drum 2, with the utilization of the difference between the potential level Vd of the unexposed portion of the surface of the photosensitive drum 2 and the potential level Vdc of the development bias; in other words, the latent image for forming a patch image is formed without exposing the photosensitive drum 2 to a beam of laser light. Then, as this latent patch image reaches the development station, the development bias applied to the development sleeve 41 is switched from the development A show in FIG. 7(*a*) to the development bias B shown in FIG. 7(*b*). Thus, the latent image is developed by the development bias B into an analog patch image. Then, as the next image formation area D reaches the development station, the development bias is switched from the development bias B to the development bias A to develop the latent image, on the image formation area D, for forming a normal image.

The development bias A shown in FIG. 7(*a*) is a blank pulse bias, and has pulse portions and blank portions. The pulse portion and black portion alternate. Each pulse portion is rectangular in waveform, and is made up of a preset number of pulses (oscillating portion, that is, combination of AC and DC voltages, which generates an alternating electric field by being applied to development sleeve 41). Each blank portion is made up of DC voltage (which is applied to development sleeve 41 to generate stable electric field). Referring to FIG. 8(*a*), the usage of the development bias A makes it unlikely for the fluctuation of the toner density in the developing device 4 to affect the image density with which a toner image is formed on the photosensitive drum 2. In the drawing, the solid line represents the ideal relationship between the image density and development contrast, whereas the dotted lines show the relationships between the image density and development contrast, which occurred as the toner density in the developing device changed. In other words, the development bias A is characterized in that it can stabilize an image forming apparatus in image density. Further, the blank bias is characterized in that it is capable of superbly (at a high level of image quality) developing the highlight portions of an image, is not likely to cause the formation of images suffering from the background fog, and is capable of keeping the toner particle size distribution stable even during an extended usage of the image forming apparatus. Further, the development bias A is unlikely to allow the fluctuation of the toner density to affect the image density with which toner images are formed. Because of these characteristics of the development bias A, controlling the toner density of the developer based on the fluctuation of the image density of the toner images developed by applying the development bias A is likely to increase the load to which the developer is subjected, accelerating thereby developer deterioration.

The development bias B, shown in FIG. 7(*b*), is a pulse bias, which is rectangular in waveform. It is an alternating bias, and is a combination of AC and DC voltages, being therefore capable of generating an alternating electric field by being applied to the development sleeve 41. Referring to FIG. 8(*b*), this development bias B is characterized in that its usage causes the image density with which images (toner images) are formed (latent images are developed), to faithfully reflect the toner density of the developer in the developing device 4. In the drawing, the solid line represents the ideal relationship between the image density and development contrast, whereas the dotted lines represent the relationships between the image density and development contrast, which reflect the fluctuation of the toner density in the developing device 4. In other words, the usage of the development bias B causes the image density with which images are formed, to accurately reflect the amount of fluctuation of toner density of the developer. When this development bias B is used, the image density with which toner images are accurately formed changes in response to the fluctuation of the toner density of the developer. Therefore, the development bias B is suitable for controlling the toner density of the developer, for the following reasons. That is, the usage of the development bias B tends to reduce the load to which the developer is subjected, preventing thereby the developer from deteriorating. Further, the usage of the development bias B reduces the fluctuation of the toner density attributable to the changes in the thickness of the film of the photosensitive drum 2, because the development bias B causes the image density with which toner images are formed, to accurately change in response to the fluctuation of the toner density.

As described above, when a latent patch image is developed, the development bias is switched from the development bias A (which makes it difficult for the image density (amount by which toner adheres) with which toner images are formed, to follow the fluctuation of the toner density of the developer, in other words, stabilizes the image density with which toner images are formed) to the development bias B, which causes image density (amount by which toner adheres) with which toner images are formed, to reflect the amount of fluctuation of toner density of the developer. Further, in this embodiment, when a patch image used for controlling the toner replenishment is formed, the image forming method is switched from the image forming method in which images are digitally formed across the image formation area, to the analog image forming method. This switching makes it possible to form an excellent patch image across the no image forming area, making it possible to improve the reliability of the value of the detection output of the image density sensor 17. Therefore, it is possible to reduce the load to which the developer is subjected, stabilizing the image forming apparatus in the image density with which it outputs images across the image formation areas.

Incidentally, the target value for the output signal of the image density sensor is set to an optimal value according to the state of the developing device usage and the ambient factors in which the developing device is used.

[Toner Replenishment Operation]

In this embodiment, as described above, only the black developing device 4Bk among the four developing devices 4Y, 4M, 4C, and 4Bk has the permeability sensor 42. Thus, when controlling the toner replenishment for the developing device 4Bk, both the inductance-based density detecting method and patch-based density detecting method can be used. In comparison, when controlling the toner replenishment for the yellow, magenta, and cyan developing devices 4Y, 4M, and 4C, the patch-based density detecting method is employed. Further, when the image forming apparatus 100 is used in the monochromatic image formation mode to form black monochromatic images, both the inductance-based density detecting method and patch-based density detecting method are used, whereas when the image forming apparatus 100 is used in the full-color image formation mode to form full-color images, only the patch-based density detecting method is used for controlling the toner replenishment for all of the yellow, magenta, cyan, and black developing devices 4Y, 4M, 4C, and 4Bk.

In this embodiment, the switching between the monochromatic image formation mode and full-color image formation mode is carried out by the CPU 61 of the engine control portion 60, which functions as a mode switching means, in response to the mode selection signal inputted by a user with the use of the control panel of the main assembly of the image forming apparatus, or the control panel (unshown) of the apparatus connected to the main assembly of the image forming apparatus. The CPU 61 controls the operation of each of the various portions of the image forming apparatus, in response to the selected mode, following the programs which regulates the image formation modes stored in the ROM 62.

Figure 10:
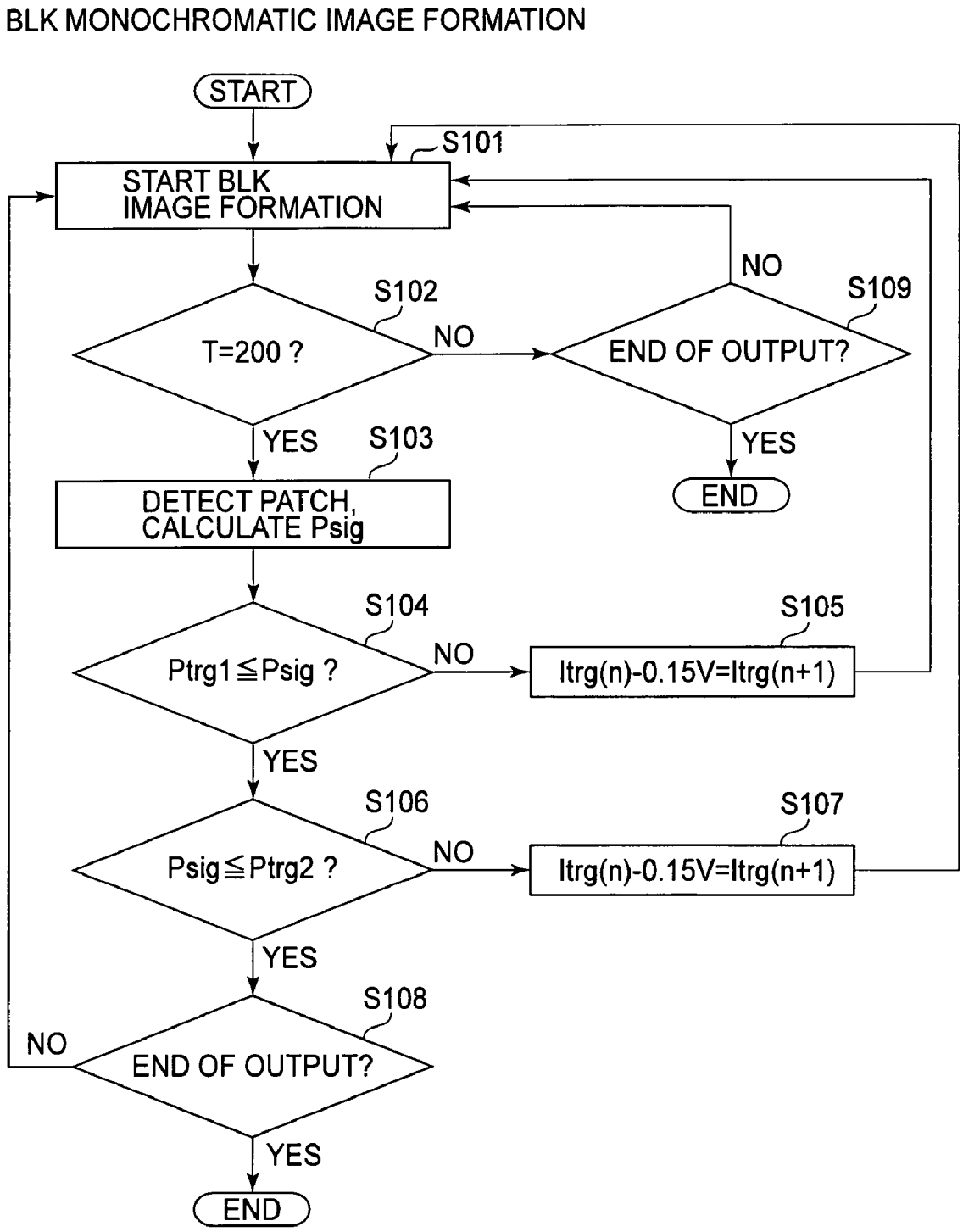
FIG. 10 is a flowchart of the toner replenishment control in the first embodiment of the present invention.

FIG. 10 is a flowchart which shows from the beginning of the image forming operation carried out in the monochromatic image formation mode to form black monochromatic images, to the end thereof. Next, the toner replenishment control which is executed in the monochromatic image formation mode will be described with reference to FIG. 10.

That is, in the monochromatic image formation mode, the target value for the inductance detection signal is adjusted according to the value of the signal which reflects the density of the patch image, which is detected by the image density sensor 17. As described above, the amount of electric charge which toner acquires is affected by the length of time the developer is used, manner in which the developer is used, changes in the ambient factors in which the developer is used, carrier deterioration, and the like factors. Thus, if the amount of electric charge which toner acquires drastically charges due to the above described reason, even if the toner density is kept constant, it is sometimes difficult to keep the image forming apparatus stable in terms of image density and color tone. In this embodiment, therefore, the target value for the signal reflecting the detected inductance is adjusted as necessary in response to the image density of the patch image, which is detected by the image density sensor 17. With this adjustment, even when the image forming apparatus is operated in the monochromatic black image formation mode, the image forming apparatus is prevented from drastically changing in image density. Next, this adjustment will be further described.

As for the referential symbols used in FIG. 10, T stands for the number of image outputs (sheets of recording mediums which bear image) after the last formation of a patch image by the developing device, and Ptrgl stands for the lowest value in the target range for the image density of a patch image. Ptrg2 stands for the highest value in the target range for the image density of a patch image. Psig stands for the signal value of the image density of the patch image, and Itrg(n) stands for the pre-adjustment target value for the inductance signal, and Itg(n+1) stands for the post-adjustment target value for the inductance signal. Incidentally, in this embodiment, the number of image outputs with which each developing device is involved is accumulated by the CPU 61, and is stored in the CPU 61 or a storage means connected to the CPU 61.

The formation of a black image is started (S101). If the number T of the image outputs after the last formation of a patch image with the use of the black developing device 4Bk reaches 200 (S102), a patch image is formed, and the image density of this patch is detected by the image density sensor 17 (S103). Then, it is determined whether or not the relationship between the detected image density Psig of the patch image and lowest value Ptrg1 in the toner image density target range satisfies Ptrg1≦Psig (S104). If the above-mentioned relationship is not satisfied in S104, 0.15 V (which is equivalent to 0.5% in toner density) is subtracted from the target value Itrg(n) for the inductance signal, obtaining the adjusted target value Itrg(n+1) for the inductance signal, from the Itrg(n); in other words, Itrg(n+1)=Itrg(n)+0.15 (S105).

On the other hand, if Ptrg1≦Psig is satisfied in S104, it is determined whether or not the detected image density Psig of the patch image and highest value Ptrg2 in the toner image density target range satisfies Psig≦Ptrg2 (S106). If the above-mentioned relationship is not satisfied in S106, 0.15 V (which is equivalent to 0.5% in toner density) is added to the target value Itrg(n) for the inductance signal, obtaining the adjusted target value Itrg(n+1) for the inductance signal from the Itrg (n); in other words, Itrg(n+1)=Itrg(n)+0.15 (S107).

If the relationship of (Psig≦Ptrg2) is satisfied in S106, the necessary number of sheets of image are outputted (S108), and the image outputting operation is ended. On the other hand, if it is determined in S102 that the number T of the sheets of image outputted with the use of the black developing device 4Bk after the last formation of a patch image has not reached 200, the necessary number of sheets of image is outputted (S109), and the image outputting operation is ended.

Incidentally, FIG. 10 is a flowchart of the operation for adjusting the toner replenishment control which employs the inductance-based density detecting method, with the use of the patch-based density detecting method. As described above, in the inductance-based density detecting method, the number of times the toner supplying screw 47 is to be rotated to supply the developing device with a proper amount of toner is calculated per recording medium P, and the toner supplying screw 47 is rotated the calculated number of times to replenish the developing device with toner.

As described above, in this embodiment, when the image forming apparatus is operated in the monochromatic image formation mode, the target value for the inductance signal is adjusted according to the signal value of the image density of the patch image detected by the image density sensor 17.

Figure 11:
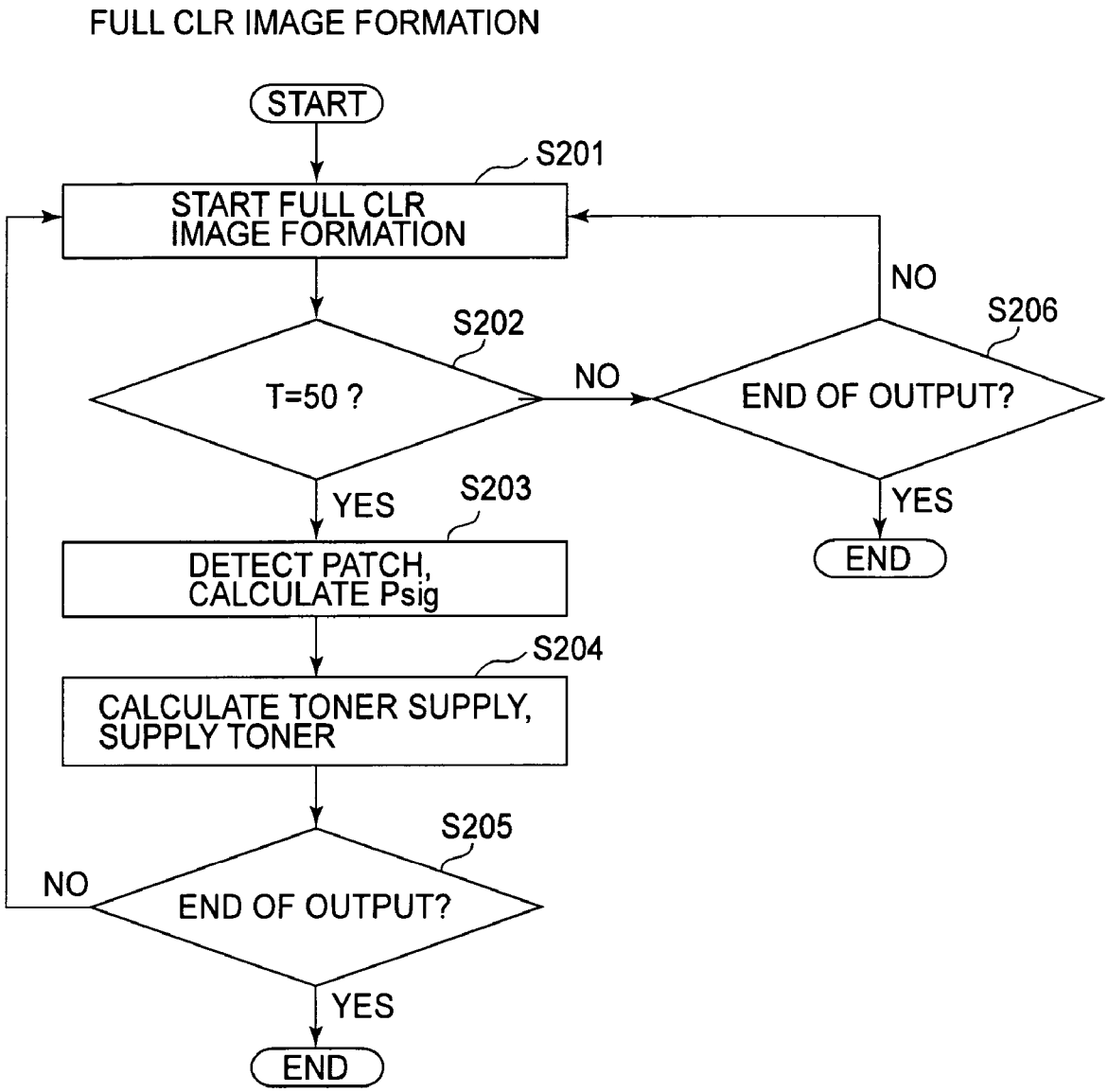
FIG. 11 is a flowchart of the toner replenishment control according to another embodiment of the present invention.

FIG. 11 is a flowchart of the full-color image forming operation, showing from the beginning of the operation to the end. Next, referring to FIG. 11, the toner replenishment control executed in the full-color mode will be described. Incidentally, the meanings of the reference characters in FIG. 11 are the same as those in FIG. 10.

When the image forming apparatus is operated in the full-color image formation mode to form full-color images, the amount by which each of the yellow, magenta, cyan, and black developing devices 4Y, 4M, 4C, and 4Bk is replenished with toner is controlled with the use of only the patch-based density detecting method. Further, the frequency with which patch images are formed when the image forming apparatus is operated in the full-color image formation mode is rendered greater than that in the monochromatic image formation mode. In this embodiment, when the image forming apparatus is operated in the full-color image formation mode, the toner replenishment control is executed every 50 outputs of sheet of image, with use of the patch-based density detecting method. Next, this toner replenishment control will be further described. All developing devices are the same in terms of the toner replenishment control.

The formation of full-color images is started (S201). If the number T of the sheets of image outputted after the last formation of a patch image with the use of each developing device 4 reaches 50 (S202), a patch image is formed, and the image density of this patch image is detected by the image density sensor 17; the image density Psig of the patch image is obtained (S203). Then, the amount by which toner is to be supplied is calculated based on the detected image density Psig of the patch image, and the toner supplying apparatus 49 is driven to replenish each developing device 4 with toner (S204). Then, the necessary number of sheets of image are outputted (S205), and the image outputting operation is ended.

As described above, in this embodiment, when durability and productivity are primary concerns (for example, when forming black monochromatic images in this embodiment), toner replenishment control is executed primarily with the use of the toner density detecting method. That is, the frequency with which a patch image is formed of black toner is higher when the image forming apparatus is operated in the full-color image formation mode than when in the monochromatic image formation mode. Therefore, controlling the toner replenishment primarily with the use of the toner density detecting method not only prevents the fluctuation of the toner density of the developer in the developing device attributable to the fluctuation of the amount of electric charge of toner attributable to the continuous extended usage of the developing devices (image forming apparatus), but also, requires no downtime, making it possible to maintain the productivity of the image forming apparatus at a high level. On the other hand, high quality is the primary concern (for example, when forming full-color images in this embodiment), the toner replenishment is controlled primarily with the use of the patch-based density detecting method (in this embodiment, only patch-based density detecting method). Therefore, it is possible to stabilize the image forming apparatus in terms of image density and color tone, improving and thereby stabilizing the image forming apparatus in terms of the image quality with which it outputs images.

To sum up, in this embodiment, the image forming apparatus 100 is provided with the multiple image formation modes, and the toner replenishment is controlled by selectively using the toner density detecting method or image density detecting method according to the purpose for which the image forming apparatus is used. More specifically, the image forming apparatus is provided with the first toner replenishment controlling means which uses the toner density detecting means, and the second toner replenishment controlling means which uses the image density detecting means. The first and second toner replenishment controlling means can be selectively used according to the purpose for which the image forming apparatus 100 is used. Therefore, it is possible to control the toner replenishment according to the primary concern of the user, that is, productivity or image quality.

Embodiment 2

Next, another embodiment of the present invention will be described. The basic structure and operation of the image forming apparatus in this embodiment are the same as those in the first embodiment. Therefore, the components of the apparatus in this embodiment, the functions and structures of which are equivalent to, or the same as, those in the first embodiment are given the same referential symbols as those given in the first embodiment, and they will not be described in detail. Hereafter, only what characterizes this embodiment will be described.

In the first embodiment, only the black developing device 4Bk among the four developing devices 4Y, 4M, 4C, and 4Bk had the permeability sensor 42, and when the image forming apparatus 100 is used in the monochromatic image formation mode to form monochromatic black images, both the inductance-based density detecting method and patch-based density detecting method are used to control the toner replenishment for the black developing device 4Bk.

Also in this embodiment, only the black developing device 4Bk among the four developing devices 4Y, 4M, 4C, and 4Bk has the permeability sensor 42. In this embodiment, however, when the image forming apparatus 100 is used in the monochromatic image formation mode to form monochromatic black images, only the inductance-based density detecting method is used to control the toner replenishment for the black developing device 4Bk; the patch-based density detecting method is not used. The toner replenishment control itself which uses the inductance-based density detecting method is the same as the one in the first embodiment described above.

Incidentally, the toner replenishment control executed for each developing device when the image forming apparatus is operated in the full-color image formation mode is the same as the one in the first embodiment. In other words, only the patch-based density detecting method is used for the toner replenishment control for all of the yellow, magenta, cyan, and black developing devices 4Y, 4M, 4C, and 4Bk.

Therefore, this embodiment has an advantage over the first embodiment in that it can further improve the image forming apparatus in productivity as necessary, and also, has an advantage over the first embodiment from the standpoint of preventing the deterioration of the developer.

Embodiment 3

Next, another embodiment of the present invention will be described. The basic structure and operation of the image forming apparatus in this embodiment are the same as those in the first and second embodiments. Therefore, the components of the apparatus in this embodiment, the functions and structures of which are equivalent to, or the same as those in the first and second embodiments are given the same referential symbols as those given in the first and second embodiments, and they will not be described in detail. Hereafter, only what characterizes this embodiment will be described.

In the first and second embodiments, only the black developing device 4Bk among the four developing devices 4Y, 4M, 4C, and 4Bk had the permeability sensor 42.

Figure 12:
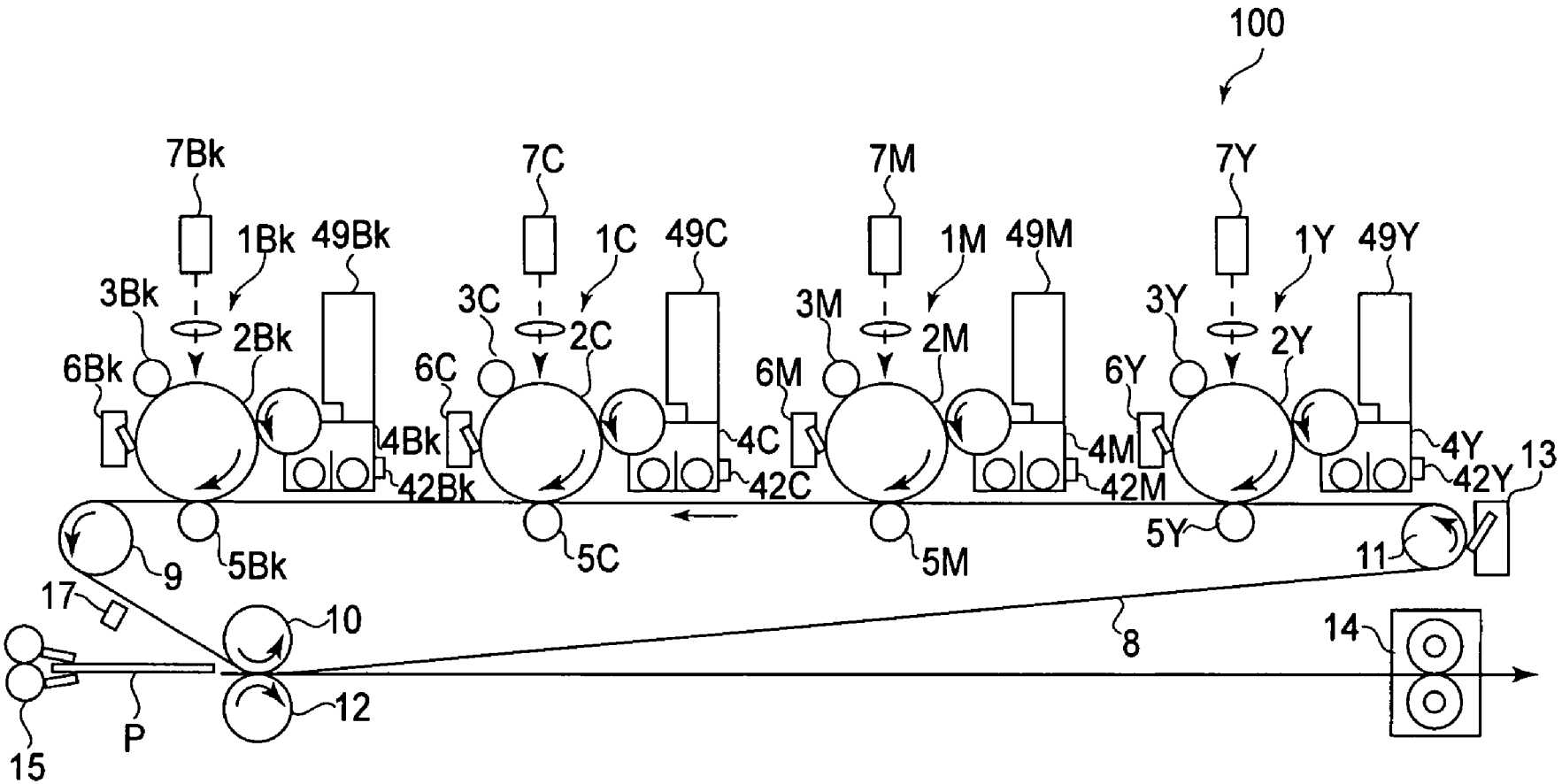
FIG. 12 is a schematic sectional view of the image forming apparatus according to another embodiment of the present invention, showing the general structure thereof.

In this embodiment, however, all of the yellow, magenta, cyan, and black developing devices 4Y, 4M, 4C, and 4Bk have the permeability sensor 42 (42Y, 42M, 42C, and 42Bk, respectively) as shown in FIG. 12. In other words, in this embodiment, all of the yellow, magenta, cyan, and black developing devices 4Y, 4M, 4C, and 4Bk have the structure shown in FIG. 3. Therefore, the toner replenishment control for each of the four developing devices 4Y, 4M, 4C, and 4Bk can be executed with the use of both the inductance-based density detecting method and patch-based density detecting method. Further, this embodiment is characterized in that the image forming apparatus is provided with multiple image formation modes in which the inductance-based density detecting method or patch-based density detecting method can be selectively used to control the toner replenishment, according to the purpose for which the image forming apparatus 100 is used by a user him- or herself. Next, this embodiment will be described in more detail.

Generally, the purpose for which an image forming apparatus is used varies depending on the user. For example, there are users who use an image forming apparatus in offices. Those users use an image forming apparatus primarily at a low level of image duty (for example, no higher than 5%: that image duty is 100% means that the image density is at the highest level across the image area of a sheet of the standard size (A4 size or the like)), and are more concerned with productivity of the apparatus than the stability of the apparatus in terms of image density and color tone, regardless of whether the apparatus is used for forming monochromatic images or full-color images. On the other hand, there are users who use an image forming apparatus at a high level of image duty (for example, no less than 20%), and are primarily concerned with the stability of the apparatus regarding the image density and color tone, regardless of whether the apparatus is used for forming monochromatic images or full-color images.

In this embodiment, therefore, it is made possible for the toner replenishment control for all the developing devices 4Y, 4M, 4C, and 4Bk to be executed with the use of both the inductance-based density detecting method and patch-based density detecting method. In addition, it is made possible to select between two image formation modes, that is, "high productivity mode" and "high image quality mode", with the use of the control portion (control panel) of the image forming apparatus 100, or the control portion (unshown) of the apparatus connected to the main assembly of the image forming apparatus 100.

If "high productivity mode" is selected by a user, the toner replenishment control for all the developing devices 4Y, 4M, 4C, and 4Bk is executed with the use of the inductance-based density detecting method. On the other hand, if "high image quality mode" is selected by a user, the toner replenishment control for all the developing device 4Y, 4M, 4C, and 4Bk is executed with the use of the patch-based density detecting method. Further, it is made possible to select either the above-mentioned "high productivity mode" or "high image quality mode", regardless of whether black monochromatic images or full-color images are formed.

More specifically, in this embodiment, the black developing device 4Bk, for example, has the following two modes. One is a first mode (high productivity mode) in which at least toner density detecting means 42Bk (permeability sensor) is used to control the amount by which toner is supplied to the black developing device 4Bk from the supplying means 49Bk (toner supplying apparatus for black developing device 4Bk). The other is a second mode (high image quality mode) in which at least the image density detecting means 17 (image density sensor) is used to control the amount by which toner is supplied to the black developing device 4Bk from the supplying means 49Bk. The image forming apparatus is structured so that even when the amount by which toner is supplied to the black developing device 4Bk from the supplying means 49Bk is controlled with the use of both the toner density detecting means 42Bk and image density detecting means 17, the frequency with which the standard toner images are formed (patch images are formed of black toner) in the second mode is higher than that in the first mode. This is true with each of the color developing devices 4Y, 4M, and 4C.

Next, paying attention to both the black developing device 4Bk (first developing device) and color developing devices (second developing devices) 4Y, 4M, and 4Bk, an image forming operation in which images are formed with the use of both the black developing device 4Bk and color developing devices 4Y, 4M, and 4C will be described. In this case, there are the first mode (high productivity mode) in which the amount, by which toner is supplied to the black developing device 4Bk and color developing devices 4Y, 4M, and 4C with the use of the first supplying means 49Bk (toner supplying means for black developing device 4Bk) and second supplying means 49Y, 49M, and 49C (toner supplying means for color developing devices 4Y, 4M, and 4C), is controlled with the use of at least the first toner density detecting means 42Bk (permeability sensor for black developing device 4Y) and second toner density detecting means 42Y, 42M, and 43C (permeability sensors for color developing devices 4Y, 4M, and 4C), respectively, and the second mode (high image quality mode) in which the amount by which toner is supplied to the black developing device 4Bk and color developing devices 4Y, 4M, and 4C from the first supplying means 49Bk and second supplying means 49Y, 49M, and 49C), respectively, is controlled with the use of at least the image density detecting means 17 (image density sensor). Further, regarding the first mode, there are cases in which the amount by which toner is supplied to the black developing device 4Bk and color developing devices 4Y, 4M, and 4C from the first supplying means 49Bk and second supplying means 49Y, 49M, and 49C, respectively, is controlled with the use of both the first toner density detecting means 42Bk and second toner density detecting means 42Y, 42M, and 43C, respectively, and the image density detecting means 17. The image forming apparatus is structured so that even in these cases of the first mode, the frequencies with which the above-mentioned first standard toner images (patch images formed of black toner) and second standard images (patch images formed of color toner) are formed in the second mode, are higher than those in the first mode.

In this embodiment, the switching between the high productivity mode and high image quality mode is done by the CPU 61 of the engine control portion 60, which functions as a mode switching means, in response to the mode selection command signal which a user inputs with the use of the control panel of the main assembly of the image forming apparatus, or the control panel (unshown) of the device connected to the main assembly of the image forming apparatus. The CPU 61 controls the operation of each of the various portions of the image forming apparatus, in response to the selected mode, following the programs which regulate the image formation modes stored in the ROM 61.

Thus, when "high productivity mode" is selected, a high level of productivity is maintained. Further, "high productivity mode" is advantageous for the prevention of developer deterioration. On the other hand, the selection of "high image quality mode" makes it possible to always keep at the proper level the image density with which the image forming apparatus forms images, making it therefore possible to prevent the image forming apparatus from deviating in color tone.

As described above, in this embodiment, all developing devices 4Y, 4M, 4C, and 4Bk have the permeability sensor 42, and the toner replenishment control for all developing devices 4Y, 4M, 4C, and 4Bk can be executed with the use of both the inductance-based density detecting method and patch-based density detecting method. Further, multiple modes are provided to enable a user to selectively use the inductance-based density detecting method or patch-based density detecting method, according to the purpose of the apparatus usage. Therefore, it is possible to form optimal images according to the primary concern of the user, that is, the productivity or image quality, regardless of whether monochromatic or full-color images are formed.

Incidentally, in this embodiment, when operating the image forming apparatus in the high image quality mode, the toner density detecting method (inductance-based toner density detective method) is employed as the method for controlling the toner replenishment. However, a toner replenishment controlling method other than the one described above may be employed. For example, the patch-based density detecting method may be employed as the primary method, along with the toner density detecting method, to control the toner replenishment, with the toner density detecting method used with less frequency than when operating in the high productivity mode.

Also in this embodiment, when operating the image forming apparatus in the high productivity mode, the toner density detecting method (inductance-based density detective method) is employed as the method for controlling the toner replenishment. However, a toner replenishment controlling method other than the one described above may be employed. For example, the toner density detecting method may be employed as the primary method, along with the patch-based density detecting method, to control the toner replenishment, with the patch-based density detecting method used with less frequency than when operating in the high image quality mode.

Embodiment 4

Next, another embodiment of the present invention will be described. The basic structure and operation of the image forming apparatus in this embodiment are the same as those in the third embodiment. Therefore, the components of the apparatus in this embodiment, the functions and structures of which are the same as, or equivalent to, those in the third embodiment are given the same referential symbols as those given in the third embodiment, and they will not be described in detail. In other words, only what characterizes this embodiment will be described.

In the this embodiment, all developing devices 4Y, 4M, 4C, and 4Bk have the permeability sensor 42, and the toner replenishment control for all developing devices 4Y, 4M, 4C, and 4Bk can be executed with the use of both the inductance-based density detecting method and patch-based density detecting method, as in the third embodiment. In other words, in this embodiment, all of the four developing devices 4Y, 4M, 4C, and 4Bk have the structure shown in FIG. 3.

In the third embodiment, it was made possible for a user him- or herself to selectively use the inductance-based density detecting method or patch-based density detecting method, to control the toner replenishment, according to the purpose of the apparatus usage.

In this embodiment, however, when forming images, the mode in which the inductance-based density detecting method is used to control the toner replenishment or the mode in which the patch-based density detecting method is used to control the toner replenishment, is selectively used according to the image information read by the image forming apparatus 100. Next, this embodiment will be described in more detail.

Generally, the number of users who prioritize high productivity over stability in image density and color tone when using the image forming apparatus at a low level of image duty (for example, no more than 5%) to form office documents or the like is overwhelming. On the other hand, when the image forming apparatus is used at a high level of image duty (for example, no less than 20%), it is the stability in image density and color tone other than the productivity that is more frequently deemed important regardless of whether monochromatic or full-color images are formed.

In this embodiment, therefore, whether the images being formed are of the low or high image duty is determined based on the image information read by the image forming apparatus 100. Then, when the images being formed are of the low image duty, the mode in which the toner replenishment is controlled with the use of the inductance-based density detecting method is selected to prioritize high productivity. On the other hand, when the images being formed are of the high in image duty, the mode in which the patch-based density detecting method is employed to control the toner replenishment is selected to prioritize high image quality. One of the above-mentioned modes is selected according the image duty, regardless of whether the images being formed are black monochromatic images or full-color images.

In this embodiment, the switching between the high productivity mode and high image quality mode is done, in response to the signals which reflect the information of the image to be outputted, by the CPU 61 of the engine control portion 60, which functions as a mode switching means. The CPU 61 controls the operation of each of the various portions of the image forming apparatus, according to the selected mode, following the programs which regulate the image formation modes stored in the ROM 61.

Figure 13:
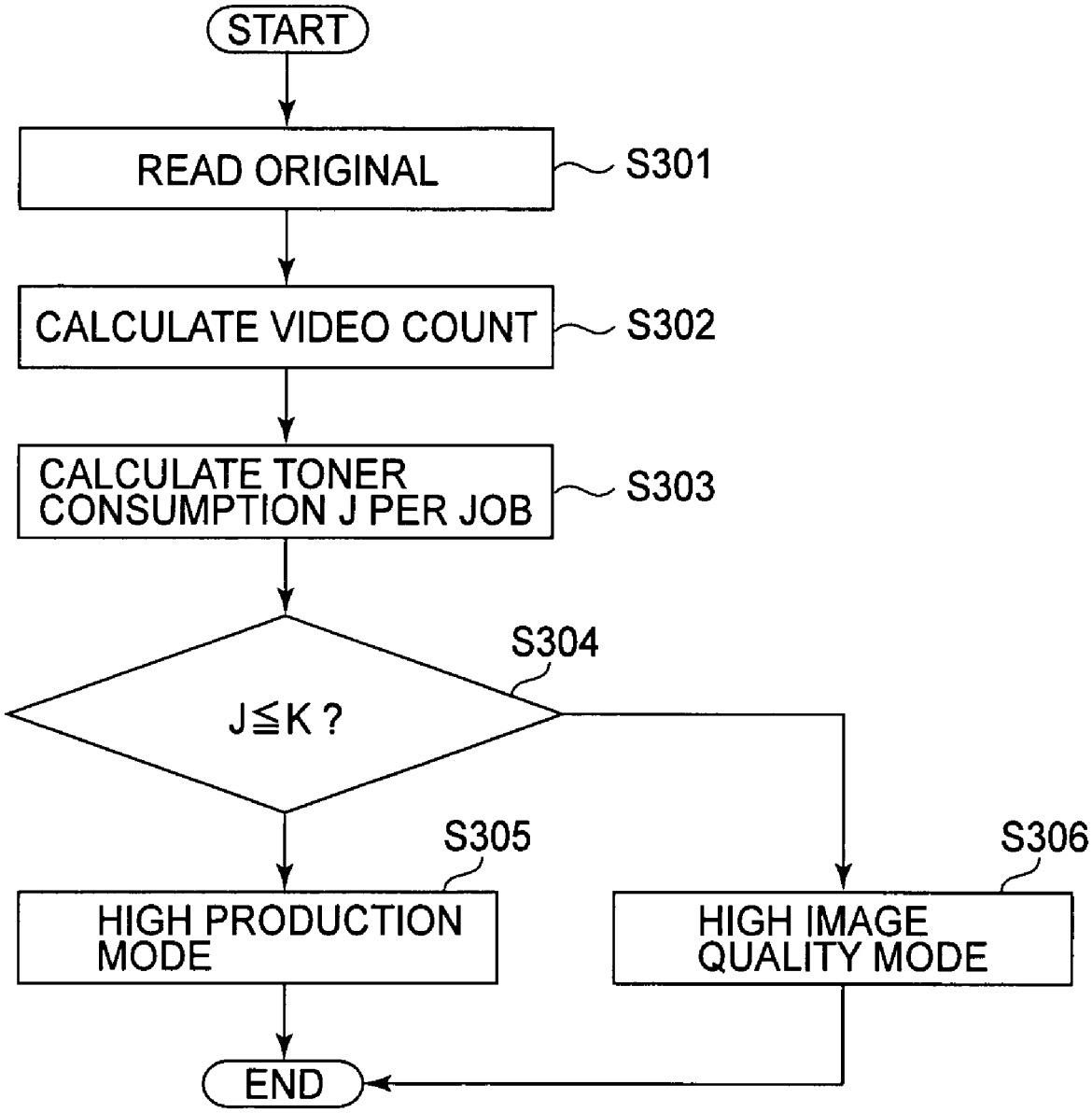
FIG. 13 is a flowchart of the toner replenishment control according to another embodiment of the present invention.

Next, referring to FIG. 13, the image forming operation in this embodiment will be described. First, the image forming apparatus 100 estimates the amount of toner consumption, based on the video count of the image density of the image information signals read by the CCD or the like of the original reading apparatus (unshown) connected to the main assembly of the image forming apparatus (or image information signals transmitted from personal computer or the like connected to apparatus main assembly) (S301, S302).

In this embodiment, the video count method is employed to calculate the image duty. More specifically, the level of the output signal of the video signal processing circuit is counted per image element. Then, the count is accumulated by the number equivalent to the number of picture elements required to form an image of the original, obtaining thereby the video count T per original (for example, maximum video count for recording medium of A4 size is 38×84×106, assuming that resolution is 400 dpi, and 256 levels of gradation are available).

The amount J of toner consumption per job (single continuum of image forming operation carried out in response to image formation start command to output single or multiple sheets of image) is calculated based on the cumulative video count, and the cumulative image output in terms of the number of outputted sheets of recording medium (S303). In this embodiment, the CPU 61 accumulates the video count T and number of image outputs (number of discharged sheets of recording medium), and also, calculates the amount J of toner consumption.

If the amount of toner consumption per job is no more than a preset threshold value K (S304), the image forming operation is carried out in the control mode (high productivity mode) in which the toner replenishment is controlled with the use of the inductance-based density detecting method (S305). On the other hand, if it is determined in S304 that the amount of toner consumption is no less than the threshold value K, the image forming operation is carried out in the control mode (high image quality mode) in which the patch-based density detecting method is used (S306).

As described above, in this embodiment, the amount of toner consumption is estimated at the beginning of an image forming operation, from the video count of the image density of the image information signals. If the amount of toner consumption is estimated to be no more than the preset threshold value, the control mode (high productivity mode) in which the inductance-based density detecting method is employed is executed to maintain the productivity of the image forming apparatus at a high level. On the other hand, if the amount of toner consumption is estimated to be no less than the preset threshold value, the toner replenish control mode (high image quality mode) based on the patch-based density detecting method is carried out. With the use of this control mode, the frequency with which toner is replaced increases, preventing thereby the problem that the image density and color tone, with which the image forming apparatus forms images, are made to fluctuate by the increase in the fluctuation of the amount of electric charge (triboelectric charge) which toner acquires. Therefore, it is possible to maintain a high level of image quality, and a high level of reliability. Also in this embodiment, when the amount of toner consumption is large, the image forming apparatus is switched in the toner replenishment control to the one in which the patch-based density detecting method is used. Therefore, the image forming apparatus is stabilized in terms of halftone images, preventing thereby the image forming apparatus from changing in the color tone with which it forms images.

As described above, in this embodiment, multiple toner replenishment control modes are provided so that the inductance-based density detecting method or patch-based density detecting method are selectively used according to the image duty. Therefore, an optimal image forming operation is carried out according to the primary concern of the user, that is, productivity or image quality, without the need for the user to carry out a specific operation.

Incidentally, in this embodiment, when operating the image forming apparatus in the high image quality mode, the patch-based density detecting method is used as a part of the method for controlling the toner replenishment. However, a toner replenishment controlling method other than the one described above may be employed. For example, the patch-based density detecting method may be employed as the primary method, along with the toner density detecting method. In such a case, the toner replenishment control based on the toner density detecting method is carried out at a lower frequency than when in the high image productivity mode.

Further, in this embodiment, when operating the image forming apparatus in the high productivity mode, the toner density detecting method (inductance-based density detecting method) is employed to control the toner replenishment. However, both the toner density detecting method and patch-based density detecting method may be employed. In such a case, the toner density detecting method is used as the primary method, and the toner replenishment control based on the patch-based density detecting method is carried out at a lower frequency than in the high image quality mode.

Embodiment 5

Figure 14:
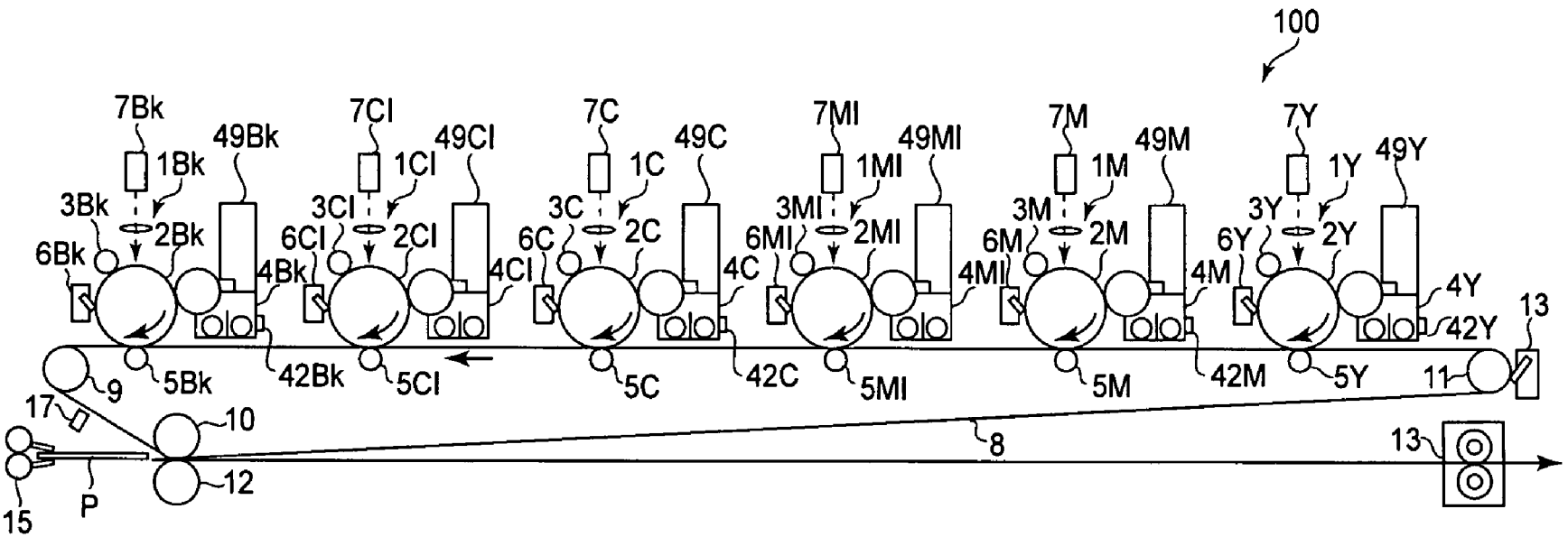
FIG. 14 is a schematic sectional view of the image forming apparatus according to another embodiment of the present invention, showing the general structure thereof.

Next, another embodiment of the present invention will be described. Referring to FIG. 14, not only does the image forming apparatus in this embodiment has the first—fourth image formation stations 1Y, 1M, 1C, and 1Bk for forming yellow, magenta, cyan, and black toner images, as does the image forming apparatus 100 in the first embodiment, but also, fifth and sixth image formation stations 1Ml and 1Cl for forming toner images of light magenta color (light magenta toner) and toner images of light cyan color (light cyan toner), respectively.

Even though the image forming apparatus in this embodiment has the additional image formation stations, that is, the fifth and sixth image formation stations 1Ml and 1Cl, respectively, as described above, the operation itself of each of its image formation stations, and the base structure and operation themselves of the image forming apparatus, are the same as those in the first—fourth embodiment. Therefore, the components of the apparatus in this embodiment, the functions and structures of which are the same as, or equivalent to, those in the first—fourth embodiments are given the same referential symbols as those given in the first—fourth embodiments, and they will not be described in detail. In other words, only what characterizes this embodiment will be described next.

That is, in this embodiment, the developing devices 4Y, 4M, 4C, and 4Bk of the first—fourth image formation stations 1Y, 1M, 1C, and 1Bk are filled with the yellow, magenta, cyan, and black toners, respectively, each of which is designed so that when the amount of the toner on recording medium P is 0.5 mg/cm$^2$, the optical density is 1.6 after fixation. As for the developing devices 4Ml and 4Cl of the fifth and sixth image formation station 1Ml and 1Cl, they are filled with the light magenta toner and light cyan toner, respectively, each of which is designed so that when the amount of the toner on recording medium P is 0.5 mg/cm$^2$, the optical density is 0.8 after fixation. Further, the difference between the abovementioned dark and light toners is effected by rendering them different in the pigment content. The pigment for dark toner and pigment for light toner are the same in spectral characteristics. In other words, in terms of the spectral characteristics of the pigment, the light magenta toner is identical to the dark magenta toner. However, the former is smaller in the pigment content than the latter. Here, the dark toner and light toner, the difference between which is effected by making them different in the pigment content (pigment for the former and pigment for the latter are the same in spectral characteristics), are treated as toners different in color.

The objective of the use of the dark and light magenta toners and the dark and light cyan toners is to drastically improve the image forming apparatus in reproducibility of an image of light color, such as, an image of human skin. (The objective is to reduce graininess).

Also referring to FIG. 14, in this embodiment, the yellow, magenta, cyan, and black developing devices 4Y, 4M, 4C, and 4Bk (developing devices for dark toner) have the permeability sensor 42. Further, both the inductance-based density detecting method and patch-based density detecting method can be used for controlling the toner replenishment for each of the developing devices 4 for the dark color. On the other hand, the light magenta and light cyan developing devices 4Ml and 4Cl (developing devices for light color toners) do not have the permeability sensor 42. The toner replenishment control for these developing devices 4Ml and 4Cl is executed with the use of the patch-based density detecting method. In other words, in this embodiment, the yellow, magenta, cyan, and black developing devices 4Y, 4M, 4C, and 4Bk (developing devices for dark toners) have the structure shown in FIG. 3, whereas the light magenta and light cyan developing devices 4Ml and 4Cl (developing devices for light color toners) have the structure shown in FIG. 2.

In this embodiment, when forming full-color images based on the four primary colors, that is, yellow, magenta, cyan, and black, the inductance-based density detecting method is used to control the toner replenishment, whereas when forming full-color images based on the six "primary" colors, that is, yellow, magenta, cyan, black, light magenta, and light cyan, the patch-based density detecting method is used for controlling the toner replenishment for all the developing devices.

In this embodiment, it is possible for a user to select either of the two modes, that is, "high color image productivity mode" and "high color image quality mode", with the use of the control panel (unshown) of the image forming apparatus. When "high productivity color mode" is selected, full-color images based on yellow, magenta, cyan, and black colors are formed. When "high image quality color mode" is selected, full-color images based on yellow, magenta, cyan, black, light magenta, and light cyan colors are formed.

In other words, when "high productivity color mode" is selected by a user, full-color images based on yellow, magenta, cyan, and black colors are formed while controlling the toner replenishment for all developing devices is executed with the use of the inductance-based density detecting method. On the other hand, when "high image quality color mode" is selected by a user, full-color images based on the six "primary" colors, which are yellow, magenta, cyan, black, light magenta, and light cyan colors, are formed while controlling the toner replenishment for all developing devices with the use of the patch-based density detecting method. Incidentally, the image forming apparatus may be provided with the monochromatic image formation mode in which only the black developing device 4Bk, for example, is used to monochromatic images, and also, in which, in order to prioritize high productivity, the toner density detecting method (inductance-based density detecting method is primarily used to control the toner replenishment. Further, the image forming apparatus may be provided with a monochromatic image formation mode in which, in order to prioritize the high image quality, the image density detecting method (patch-based density detecting method) is employed as the primary density detecting method to control the toner replenishment.

Here, paying attention to the black developing device 4Bk, for example, the image forming apparatus 100 has a first image formation mode (high productivity color mode) in which the amount by which toner is supplied to the black developing device 4Bk from the supplying means 49Bk (toner supplying apparatus for black developing device 4Bk) is controlled with the use of at least the image density detecting means 17 (image density sensor). Further, the image forming apparatus 100 has a second image formation mode (high image quality color mode) in which the amount by which toner is supplied to the black developing device 4Bk from the supplying means 49Bk (toner supplying apparatus for black developing device 4Bk) is controlled with the use of at least the toner density detecting means 42Bk (permeability sensor). Moreover, the image forming apparatus is structured so that when the amount by which toner is supplied to the black developing device 4Bk from the supplying means 49Bk is controlled with the use of both the toner density detecting means 42Bk and image density detecting means 17, the frequency with which the standard toner images (patch images formed of black toner) are formed in the second image formation mode is higher than that in the first image formation mode. This is true with the other developing means for the dark toners, that is, developing devices 4Y, 4M, and 4C.

Next, paying attention to the developing devices which use the dark toner (first developing devices), which are the developing devices 4Y, 4M, 4C, and 4Bk, and the developing devices which use the light toner (second developing devices), which are developing devices 4Ml and 4Cl, an image forming operation in which images are formed using only the developing devices 4Y, 4M, 4C, and 4Bk, which use the dark toner, is described. In this case, the image forming apparatus is operated in the first image formation mode (high productivity color mode) in which the amount by which toner is supplied to the developing devices 4Y, 4M, 4C, and 4Bk (developing devices which use dark toner) from the first supplying means 49Y, 49M, 49C, and 49Bk (toner supplying apparatuses for developing devices 4Y, 4M, 4C, and 4Bk, that is, developing devices which use dark toner), is controlled with the use of at least the toner density detecting means 42Y, 42M, 42C, and 42Bk, respectively. Next, an image forming operation in which images are formed using both the developing devices which use the dark toner, that is, the developing devices 4Y, 4M, 4C, and 4Bk, and the developing devices which use the light toner, that is, the developing devices 4Ml and 4Cl, will be described. In this case, the image forming apparatus is operated in the second image formation mode (high image quality color mode) in which the amount by which toner is supplied to the developing devices 4Y, 4M, 4C, and 4Bk (developing devices which use dark toner) from the first supplying means 49Y, 49M, 49C, and 49Bk (toner supplying apparatuses for developing devices 4Y, 4M, 4C, and 4Bk, that is, developing devices which use dark toner), and the amount by which toner is supplied to the developing devices which use the light toner, that is, the developing devices 4Ml and 4Cl, from the second supplying means 49Ml and 49Cl (toner supplying apparatus for developing devices 4Ml and 4Cl which use light toner), are controlled with the use of at least the image density detecting means 17 (image density sensor). There are cases in which when the image forming apparatus is operated in the first image formation mode, the amount by which toner is supplied to the developing devices which use the dark toner, that is, the developing devices 4Y, 4M, 4C, and 4Bk, from the first supplying means 49Y, 49M, 49C, and 49Bk, respectively, is controlled with the use of both the toner density detecting means 42Y, 42M, 42C, and 42Bk and image density detecting means 17. The image forming apparatus is structured so that even in these cases, the frequency with which the first standard toner images (patch image formed of dark toner) are formed in the second mode is higher than that in the first mode.

In this embodiment, the switching between the high productivity color mode and high image quality color mode is made in response to the signals which reflect the information of the image to be outputted, by the CPU 61 of the engine control portion 60, which functions as a mode switching means. The CPU 61 controls the operation of each of the various portions of the image forming apparatus, according to the selected mode, following the programs which regulate the image formation modes stored in the ROM 62.

Therefore, the selection of "high productivity color mode" makes it possible to maintain a high level of productivity. It is also advantageous from the standpoint of preventing the developer deterioration. On the other hand, the selection of the "high image quality color mode" makes it possible to always maintain a proper level of image density, making it thereby possible to reliably form high quality images.

Incidentally, in this embodiment, when the image forming is operated in the high image quality color mode, the patch-based density detecting method is used as a part of the method for controlling the toner replenishment. However, a toner replenishment controlling method other than the method in this embodiment may be employed along with the toner replenishment controlling method in this embodiment. For example, a method in which the light magenta developing device and light cyan developing device are provided with the toner density detecting means, and the patch-based density detecting method is used as the primary density detecting means so that the toner replenishment control based on the toner density detecting method is executed at a lower frequency than when the image forming apparatus is operated in the high productivity color mode, may be used in conjunction with the toner replenishment controlling method in this embodiment.

Also in this embodiment, when the image forming operation is operated in the high productivity color mode, the toner density detecting method (inductance-based density detecting method) is employed as a part of the method for controlling the toner replenishment. However, a toner replenishment controlling method other than the method in this embodiment may be employed along with the toner replenishment controlling method in this embodiment. For example, a method in which the toner density detecting method is used as the primary density detecting means so that the toner replenishment control based on the patch-based density detecting method is executed at a lower frequency than when the image forming apparatus is operated in the high image quality color mode may be employed in conjunction with the toner replenishment controlling method in this embodiment.

In the above, the present invention was described with reference to the preferred embodiments of the present invention. The embodiments described above are not intended to limit the scope of the present invention.

For example, in the embodiments described above, the permeability sensor was used as a toner density detecting means. However, the choice of the toner density detecting means does not need to be limited to the permeability sensor. It is needless to say that an optical sensor which detects the reflected amount of light when light is projected upon the developer in a developing device such as those described above may be employed as a toner density detecting means.

Further, the patch-based density detecting method in each of the embodiments described above is such that the image density detecting means is disposed so that it opposes the intermediary transfer belt to detect the image density of the patch image on the intermediary transfer belt. However, the selection of the patch-based density detecting method does not need to be limited to the above-described one. For example, the image density detecting means may be disposed in a manner to oppose the peripheral surface of a photosensitive drum so that the image density of the patch image formed of toner is detected on the photosensitive drum. In the case of an image forming apparatus provided with multiple photosensitive drums, multiple image density detecting means may be disposed in a manner to oppose the multiple photosensitive drums one-for-one.

Further, in each of the embodiments described above, the present invention was applied to the image forming apparatuses which employ the intermediary transferring means. However, the application of the present invention does not need to be limited to image forming apparatuses such as those described above. For example, it has been well-known to the people working in the field of an image forming apparatus that the present invention is also applicable to image forming apparatuses of the direct transfer type, which has a recording medium bearing means, which bears and conveys recording medium, instead of having the intermediary transfer member. When an image forming of the direct transfer type, such as the one described above, is used to form color images, toner images formed sequentially on a single image bearing member, or toner images formed on multiple image bearing members one for one, are sequentially transferred in layers directly onto the recording medium borne on the recording medium bearing member; multiple toner images different in color are directly layered on the recording medium. Thereafter, a permanent copy is obtained by fixing these toner images to the recording medium. Obviously, images can be formed by an image forming apparatus of the direct transfer type such as the one described above, with the use of a single toner or a combination of two or more toners different in color (not all toners) with which the apparatus is provided. Further, each of the developing devices of an image forming apparatus of the direct transfer type which are different in the color of the developer therein, can also be provided with a toner density detecting means. Further, an image forming apparatus of the direct transfer type can also be provided with an image density detecting means which detects the image density (amount of adhered toner) of a toner image on an image bearing member or a recording medium bearing member. Therefore, the present invention is also applicable to an image forming apparatus of the direct transfer type, such as the above-described one, just as satisfactorily as is to the image forming apparatuses in the preceding embodiments.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 246892/2005 filed Aug. 26, 2005 which is hereby incorporated by reference.

What is claimed is:

1. An image forming apparatus comprising:

a first developing device for developing an electrostatic image with a first developer including a first toner;

a second developing device for developing an electrostatic image with a second developer including a second toner which is different from the first toner;

a first supplying device for supplying the first toner into said first developing device;

a second supplying device for supplying the second toner into said second developing device;

a toner content detecting device for detecting a toner content in the first developer in said first developing device;

an image density detecting device for detecting an image density of a reference toner image formed using said first developing device and said second developing device; and a controller for operating said image forming apparatus selectively in:

a first mode in which an image forming operation is performed using only said first developing device, and in which said first supplying device supplies the first toner based on at least a detection result of said toner content detecting device, and a second mode in which an image forming operation is performed using said first developing device and said second developing device, and in which said first supplying device and said second supplying device supply the first toner and the second toner, respectively, based on at least a detection result of said image density detecting device, wherein when the toner is supplied on the basis of a result of detection, by said image density detecting device, of the reference toner image formed at a predetermined interval or for each of a predetermined number of image formations in each of the first and second modes, said controller operates said image forming apparatus such that the predetermined interval is longer, or the predetermined number of image formations is greater in the first mode than in the second mode.

2. An image forming apparatus according to claim 1, wherein in the second mode, said controller controls said first toner supply device and said second toner supply device to supply the toner on the basis a detection result of said image density detecting device without using said toner content detecting device.

3. An image forming apparatus comprising:

a first developing device for developing an electrostatic image with a first developer including a first toner;

a second developing device for developing an electrostatic image with a second developer including a second toner which is different from the first toner;

a first supplying device for supplying the first toner into said first developing device;

a second supplying device for supplying the second toner into said second developing device;

a toner content detecting device for detecting a toner content in the first developer in said first developing device;

an image density detecting device for detecting an image density of a reference toner image formed using said first developing device and said second developing device; and a controller for operating said image forming apparatus selectively in:

a first mode in which an image forming operation is performed using only said first developing device, and a second mode in which an image forming operation is performed using said first developing device and said second developing device, wherein said controller controls said image forming apparatus such that:

in the first mode, said first supplying device supplies the first toner based on a detection result of said toner content detecting device without being based on a detection result of said image density detecting device, and in the second mode, said first supplying device and said second supplying device supply the first toner and the second toner based on a detection result of said image density detecting device without being based on a detection result of said toner content detecting device.

4. An image forming apparatus according to any one of claims 1-3, wherein said controller determines whether said image forming apparatus operates in the first mode or the second mode on the basis of an image information signal upon starting image formation.

5. An image forming apparatus according to any one of claims 1-3, further comprising an operating portion for permitting an operator to select the first mode or the second mode, wherein said controller carries out a mode inputted at the operating portion.

6. An image forming apparatus according to any one of claims 1-3, wherein said toner content detecting device detects a magnetic permeability of at least one of the first developer in said first developing device and the second developer in said second developing device, or a reflected light quantity of the light reflected by at least one of the first developer in said first developing device and the second developer in said second developing device.

7. An image forming apparatus according to any one of claims 1-3, wherein said image density detecting device detects a quantity of light reflected by the reference toner image.

8. An image forming apparatus comprising:

a developing device for developing an electrostatic image with a developer including toner;

a supplying device for supplying the toner into said developing device;

a toner content detecting device for detecting a toner content in the developer in said developing device;

an image density detecting device for detecting an image density of a reference toner image formed by said developing device; and a controller for operating said image forming apparatus selectively in:

a first mode in which said supplying device supplies the toner based on at least a detection result of said toner content detecting device, and a second mode in which said supplying device supplies the toner based on a detection result of said image density detecting device without being based on a detection result of said toner content detecting device, wherein when the toner is supplied on the basis of a result of detection, by said image density detecting device, of the reference toner image formed at a predetermined interval or for each of a predetermined number of image formations in each of the first and second modes, said controller operates said image forming apparatus such that the predetermined interval is longer, or the predetermined number of image formations is greater in the first mode than in the second mode.

* * * * *